United States Patent [19]

Horinouchi

[11] Patent Number: 4,517,429

[45] Date of Patent: May 14, 1985

[54] ELECTRONIC CONTROLLED HEAT COOKING APPARATUS AND METHOD OF CONTROLLING THEREOF

[75] Inventor: Atsushi Horinouchi, Otsu, Japan

[73] Assignee: Sanyo Electric Co., Ltd., Japan

[21] Appl. No.: 339,057

[22] Filed: Jan. 13, 1982

Related U.S. Application Data

[63] Continuation of Ser. No. 76,754, Sep. 18, 1979, abandoned.

[30] Foreign Application Priority Data

Dec. 14, 1978 [JP] Japan ..... 53-158962

[51] Int. Cl.[3] ..... H05B 6/68

[52] U.S. Cl. ..... 219/10.55 B; 219/10.55 R; 99/325

[58] Field of Search ..... 219/10.55 B, 10.55 M, 219/10.55 E, 10.55 R; 99/325, 326, 327, 451, DIG. 14; 426/243, 523

[56] References Cited

U.S. PATENT DOCUMENTS

| | | | |
|---|---|---|---|
| 3,259,056 | 7/1966 | King | 99/325 |
| 3,932,723 | 1/1976 | Tamano et al. | 219/10.55 B |
| 4,171,382 | 10/1979 | Buck | 219/10.55 EX |
| 4,255,639 | 3/1981 | Kawabata et al. | 219/10.55 B |
| 4,328,408 | 5/1982 | Lawson | 219/10.55 B |

OTHER PUBLICATIONS

"Converting Recipes", Richard Deacon's Microwave Cookery, pp. 11-12; published by HP Books, 1977.

Food Engineering, Nov. 1964, "Consider Microwaves", Jeppson.

Ad brochure from Toshiba GR-899BT-1 "The Brainwave", May 1977.

Microwave Oven Controller Manual, Texas Instruments, Inc. 1976.

*Primary Examiner*—P. H. Leung

*Attorney, Agent, or Firm*—Darby & Darby

[57] ABSTRACT

A microwave oven with a microprocessor and a read only memory for storing a plurality of cooking programs corresponding to a plurality of recipes. The cooking program corresponding to each recipe comprises data concerning a heating energy intensity and a cooking time period as determined for a unit quantity of a material to be cooked. The microwave oven is adapted for the entry of data representing the actual quantity of a material to be cooked relative to said unit quantity, and the microprocessor is adapted such that the cooking time period of a selected cooking program is modified as a function of said quantity data, whereby a modified cooking time period is set. A magnetron oscillator is controlled based on the heating energy intensity read out from the selected cooking program and the modified cooking time period prepared by means of the microprocessor, whereby a heat cooking operation best suited for the actual quantity of the material to be cooked is automatically performed.

1 Claim, 27 Drawing Figures

| KEY | | | SA2, SA1, SA0 |
|---|---|---|---|
| 1 | START | CLOCK | 0 0 1 |
| 2 | STOP | TIMER | 0 1 0 |
| 3 | 0 | POWER | 0 1 1 |
| 4 | 7 | RECIPE | 1 0 0 |
| 5 | 8 | QUANTITY | 1 0 1 |
| 6 | 9 | CLEAR | 1 1 0 |

| KEY | | CODE |
|---|---|---|
| 0 | | 0 0 0 0 |
| 1 | CLOCK | 0 0 0 1 |
| 2 | TIMER | 0 0 1 0 |
| 3 | POWER | 0 0 1 1 |
| 4 | RECIPE | 0 1 0 0 |
| 5 | QUANTITY | 0 1 0 1 |
| 6 | CLEAR | 0 1 1 0 |
| 7 | START | 0 1 1 1 |
| 8 | STOP | 1 0 0 0 |
| 9 | | 1 0 0 1 |

103

| DPH \ DPL | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0 | DISPLAY | | | | PWR B | PWR A | | | | | | RF | | NKB | KNF | FKB |
| 1 | TIMER | | | | POW-ER | RECI-PE | QUAN-TITY | | | | | | | | | |
| 2 | TIMER B | | | | | | QK | | | | | | | | | |
| 3 | CLOCK | | | | CNT 1 | | CNT 2 | | CNT3 | | | | | | | |

| | | | | |
|---|---|---|---|---|
| KNF | FK | NK | KE | COL |
| RF | BSY | SET | PWR | SEC |

ELECTRONIC CONTROLLED HEAT COOKING APPARATUS AND METHOD OF CONTROLLING THEREOF

This is a continuation of application Ser. No. 076,754, filed Sept. 18, 1979, now abandoned.

BACKGROUND OF THE INVENTION

The present invention relates to an electronically controlled heat cooking apparatus and a method of controlling the same. More specifically, the present invention relates to an improvement of a heat cooking apparatus employing a microprocessor for the purpose of controlling heating conditions and a method of controlling the same.

DESCRIPTION OF THE PRIOR ART

A microwave oven is well-known as an example of a heat cooking apparatus. Of late, a microprocessor implemented by large scale integration has been employed in such microwave ovens for the purpose of performing various cooking functions with a simple circuit configuration and through simple manipulation.

One of such cooking functions comprising a fixed cooking program function. According to such function, the respective cooking conditions, such as heating energy intensity, cooking time period and the like, associated with a plurality of recipes are in advance stored in a memory of a cooking apparatus. On the occasion of a cooking operation, a desired recipe is simply selected by an operator or a cook, without selecting said cooking conditions, such as heating energy intensity, cooking time period and the like. According to said recipe selection, a corresponding cooking condition is read out from the memory and is automatically set. Accordingly, it is not necessary for an operator to memorize various cooking conditions nor to refer to a correlation table of the recipes and the cooking conditions. Thus, such a cooking apparatus employing such a function is very convenient to an operator or a cook.

In actuality, however, it has been observed that even in the case of the same receipt, optimum cooking conditions differ depending on characteristics of the material to be cooked such as its weight, for example. Nevertheless, according to a conventional fixed cooking program function, it is not possible to enter data concerning said conditions of the material to be cooked into the memory of the cooking apparatus. As a result two materials would be cooked under the same cooking conditions in spite of having different characteristics such as weight, insofar as the same recipe is selected. This causes an undesirable cooking operation.

In particular, in the case where microwave energy is employed as heating energy, the above described problem is aggravated in that certain heating conditions differ greatly depending on the characteristics of the material being heated. More specifically, in the case of a microwave oven, conditions in the cooking chamber affect the load as viewed from the microwave source. A change in the conditions in the cooking chamber may occur by virtue of a change in a characteristic of the material being cooked, such as the weight of the material. This causes a change in the impedance matching state between the cooking chamber and the microwave source, thereby causing a change in the supply of microwave energy to the cooking chamber.

In consideration of the foregoing problem, a microwave oven has been proposed wherein the cooking time period of a fixed cooking program is modified in accordance with the weight of the material to be cooked. An example of such a microwave oven is disclosed in U.S. Pat. No. 3,932,723, issued Jan. 13, 1976 and entitled "ELECTRONIC RANGE WITH AUTOMATIC ELECTRONIC DIGITAL TIMER". The above referenced United States patent fails to show employment of a microprocessor but teaches automatic setting of a modified cooking time period in association with the quantity and the kind of a material being cooked in a microwave oven. More specifically, the above referenced United States patent shows a microwave oven adapted such that the quantity of material to be cooked is entered by setting a material quantity entry means, and the kind of material to be cooked is also entered. A step function generator is structured to generate a step having a duration necessary to cook a reference amount of the kind of material entered. More specifically, the cycle of oscillation of the step function generator is changed in association with the operation of a selection switch for selecting the kind of material to be cooked. In addition, a value is set in a counter corresponding to the setting of the quantity of the material to be cooked. The counter is structured to make a down count operation responsive to the above described step, the duration of which is changed responsive to the setting of the kind of material to be cooked. If and when the value in the counter as down counted reaches a prescribed value, say zero, a heating operation is stopped responsive thereto to terminate cooking. Thus a modified cooking time period is determined in association with the quantity and the kind of material to be cooked. According to the above referenced U.S. Pat. No. 3,932,723, a cooking operation is performed such that a cooking condition such as the cooking time period is modified in a linear proportional relation with the quantity of a material to be cooked, with the result that an optimum cooking time period in association with the quantity of the material to be cooked cannot be accurately set. The reason is that in controlling the amount of heating energy to be supplied to the material to be cooked in association with the quantity of said material in such a fixed cooking program function, particularly in the case of employment of microwave energy as heating energy, there is no linear proportional relation between the quantity of material to be cooked and the duration of a supply of microwave power for optimum cooking. Accordingly, it is improper and inaccurate to increase said duration of microwave power supply in a linear proportion to the quantity of material to be cooked, such as two times an original time period for two times an original quantity. Furthermore, the above referenced United States patent is structured such that a change of a cooking time period is made by changing an oscillation time constant of air oscillator in association with the kind of material to be cooked, which means that as the number of kinds of materials to be cooked is increased the number of circuits associated with the kinds of materials need be accordingly increased. In addition, the above referenced United States patent is structured such that a value is set in a counter in association with the quantity of material to be cooked. Only the duration of the step being applied to the counter is changed in association with the kind of material to be cooked. Since this simply modifies the cooking time period in association with the quantity and kind of material to be cooked, other cooking conditions such as the output of an energy source cannot be changed.

SUMMARY OF THE INVENTION

Briefly described, according to the present invention, taking note of a non-linear relation between a material to be cooked and an amount of energy to be supplied, data concerning the above described non-linear relation is stored in a memory. A cooking condition then determined by entering the quantity of a material to be cooked and by referring to the stored non-linear relation between the quantity of a material to be cooked and the amount of energy to be supplied. Thus, according to the present invention, the optimum value of said cooking condition can be accurately determined and controlled in association with the quantity of a material to be cooked.

In a preferred embodiment of the present invention, a microprocessor is employed in a cooking apparatus, wherein a cooking condition of a fixed cooking program is modified by means of the microprocessor by referring to a stored non-linear relation in association with an actual quantity of a material to be cooked. The stored non-linear relation may be commonly utilized irrespective of the kinds of materials to be cooked. By employing such a structure, the capacity of a memory for storing the above described non-linear relation may be minimized.

In a further preferred embodiment of the present invention, a fixed cooking program is stored such that cooking conditions as determined for a unit quantity of a material to be cooked are stored for a plurality of recipes or kinds of cooking and data to be entered concerning the actual quantity of a material to be cooked is represented as a multiple of the unit quantity. The above described non-linear relation is stored as a series of data representing multiples of the above described unit quantity and corresponding coefficients. Accordingly, the data representing the actual quantity of a material to be cooked may be simply entered as a multiple.

Accordingly, a principal object of the present invention is to provide an improved electronically controlled heat cooking apparatus and method.

Another object of the present invention is to provide a heat cooking apparatus and method for automatically cooking a material to be cooked under a proper and accurate cooking condition in association with a characteristic of the material to be cooked.

A further object of the present invention is to provide an electronically controlled heat cooking apparatus and method, wherein a non-linear relation between the quantity of a material to be cooked and the amount of heating energy to be supplied is pre-set in a memory and a cooking condition is determined in response to the actual quantity of a material to be cooked and with reference to the stored non-linear relation.

Still another object of the present invention is to provide an electroncially controlled heat cooking apparatus and method, wherein a non-linear relation between the quantity of a material to be cooked and the amount of heating energy to be supplied is stored in a memory and a cooking condition is determined in response to the actual weight of a material to be cooked and with reference to the stored non-linear relation, characterized in that the above described non-linear relation is selected to be common to all the recipes or the kinds of cooking, whereby the capacity of the memory for storing the above described non-linear relation may be minimized.

Still a further object of the present invention is to provide a heat cooking apparatus employing a microprocessor as a control means, whereby proper and accurate cooking conditions can be set.

It is another object of the present invention to provide a heat cooking apparatus, wherein a proper and accurate cooking operation can be easily programmed.

It is a further object of the present invention to provide a microwave cooking apparatus, wherein microwave energy is utilized as heating energy and a fixed cooking program function is employed to perform the above described objects and features of the present invention.

These objects and other objects, features, aspects and advantages of the present invention will become more apparent from the following detailed description when taken in conjunction with the accompanying drawings.

DESCRIPTION OF THE PREFERRED EMBODIMENTS

In the following, the present invention will be described as embodied in a microwave oven; however, the same should not be construed by way of limitation. It should be pointed out that the present invention can be practiced in any other types of heat cooking apparatus for cooking a material being heated such as a food material by heating the same, such as a gas oven, an electrical oven or grill, an electrical roaster or the like.

Figure 1:
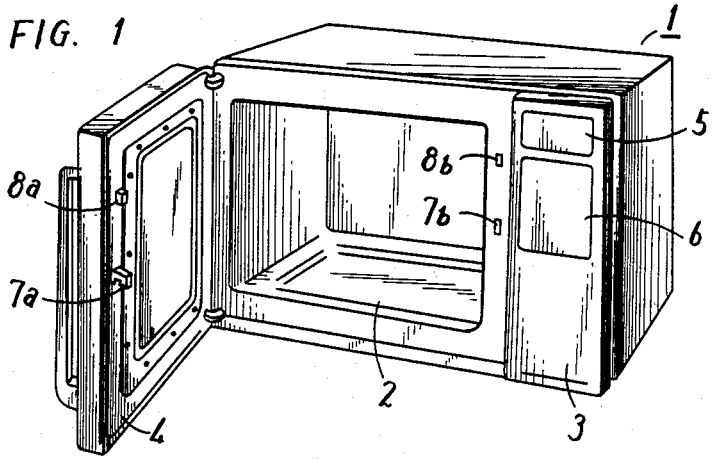
FIG. 1 is a perspective view of a microwave oven embodying the present invention.

FIG. 1 is a perspective view of a microwave oven illustrating an embodiment of the present invention. The microwave oven 1 comprises a main body including a cooking chamber 2 and a control panel 3, and a door 4 hinged to the main body to close the opening of the cooking chamber 2. The control panel 3 comprises a display portion 5 for displaying in a digital fashion the information conerning a cooking time period and the like, and data entry means 6 for manually operating the function of the microwave oven, as to be more fully described subsequently. The door 4 is provided on the inner surface thereof with a door latch 7*a* and a door switch knob 8*a*, so that, when the door 4 is closed, these enter into apertures 7*b* and 8*b* formed at the corresponding portions of the main body to turn on an interlock switch and a door switch, respectively, which are not shown in FIG. 1 and will be described subsequently.

Figure 4:
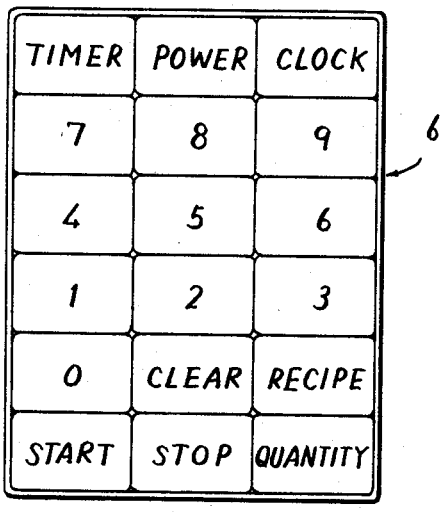
FIG. 4 is a plain view showing in detail a data entry means comprising a keyboard.
Figure 2:
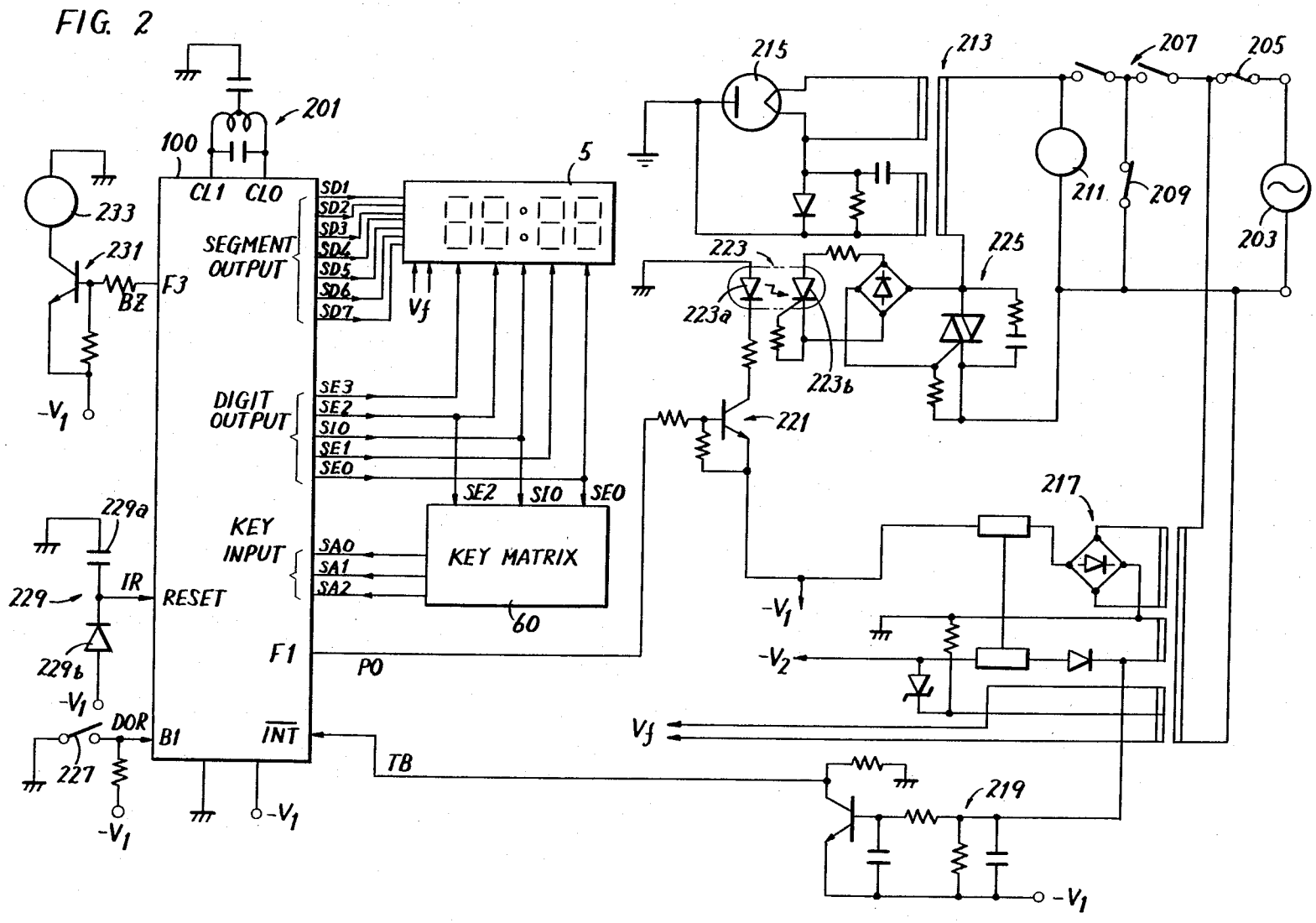
FIG. 2 is a schematic diagram of one embodiment of the present invention.
Figures 5, 6A, 6B:
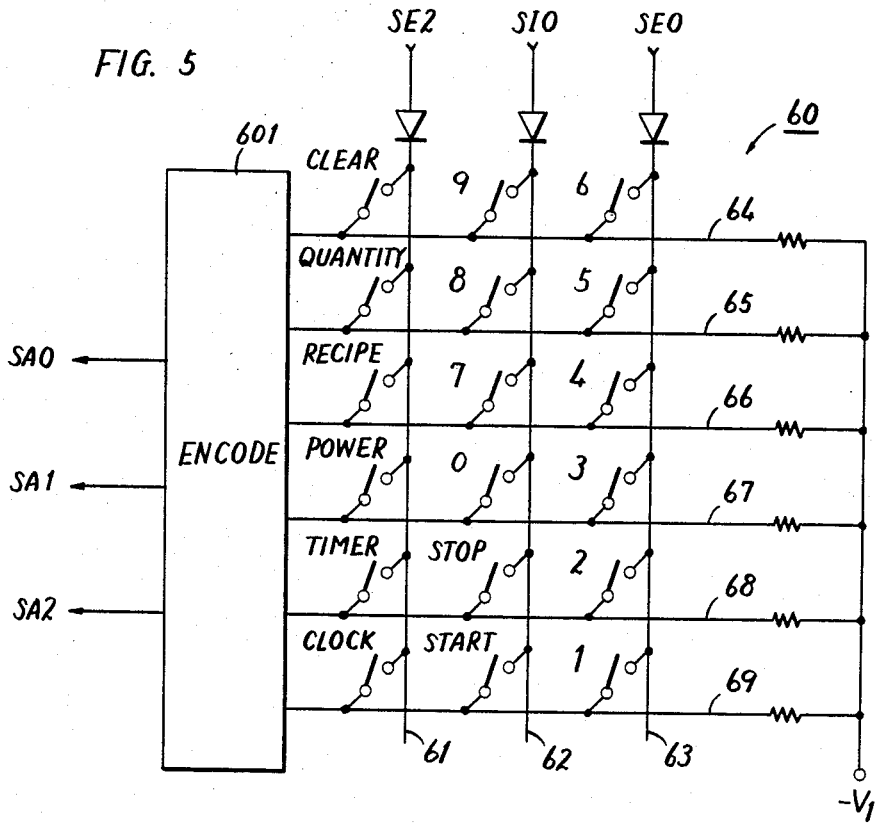
FIG. 5 is a schematic diagram of a key matrix of the keyboard.
FIG. 6A is a table showing the relation between the outputs of the key matrix and the respective keys in the preferred embodiment.
FIG. 6B is a table showing the binary coded decimal code corresponding to the respective keys.

FIG. 2 shows a schematic diagram of a preferred embodiment of the present invention. The embodiment shown employs a one chip microprocessor as a control means. By way of an example of such a microprocessor, Part No. MPD-553 manufactured by Nippon Electric Company, may be used. Terminals CL1 and CL0 of the microprocessor 100 are connected to an exterior part 201 for the purpose of providing operation clocks of a frequency such as 400 kHz to operate the one chip microprocessor 100. The microprocessor 100 is also connected to data entry means such as keyboard 6, as shown in FIG. 4 to be described subsequently, and thus to input lines of a key matrix 60, as shown in FIG. 5 to be described subsequently. The microprocessor 100 is also connected to a segment type digital display means 5, as shown in FIG. 3 to be described subsequently. The digital display means 5 is provided with well-known signals to display data such as segment selecting signals SD1 to SD7, and digit selecting signals SE0 to SE3 and SI0 from the microprocessor 100. The digit selecting signals SE0, SE2 and SI0 are also applied to the column lines of the above described key matrix 60. Signals SA0 to SA2 from the row lines of the key matrix 60 are applied to the microprocessor 100.

Electrical source 203 comprises an alternating current voltage source such as a commercial power supply of 60 Hz. Electrical source 203 is connected in series with a fuse 205, an interlock switch 207, a primary winding of a high voltage transformer 213 and a bidirectional thyristor 225. A monitor switch 209 is connected in parallel with the alternating current voltage source 203 through the fuse 205 and the interlock switch 207. The monitor switch 209 operates in a manner directly opposite to that of the interlock switch 207. If and when the interlock switch 207 and monitor switch 209 are both closed, the fuse 205 is melted. A blower motor 211 is further connected in parallel with electrical source 203 through the fuse 205 and the interlock switch 207. Accordingly, the blower motor 211 is energized, if and when the interlock switch 207 is turned on. The secondary winding of the high voltage transformer 213 is connected to a cathode of a magnetron tube 215. Between the anode and cathode of the magnetron tube 215 is connected a half-wave voltage doubling and rectifying circuit including a third winding of the high voltage transformer 213.

A voltage source circuit 217 is further connected to the electrical source 203 through the fuse 205. The voltage source circuit 217 comprises a well-known transformer, rectifying circuit and the like to provide direct current operation voltages $-V_1$ and $-V_2$. One winding of the transformer included in the voltage source circuit 217 is connected to the input of a time base circuit 219. The time base circuit 219 is responsive to the alternating current of the frequency of say 60 Hz obtained from the electrical source 203 to provide a time base signal TB, which is applied to the input terminal INT of the microprocessor 100. The above described time base signal TB is treated as a time base reference signal for controlling a cooking time period and for controlling a timing operation.

The microprocessor 100 is also adapted to provide a control signal PO from the terminal F1 for tuning on or off the electrical source, which is applied to the base electrode of a transistor 221. The emitter electrode of the transistor 221 is connected to a reference voltage $-V_1$. A light-emitting diode 223*a* is connected to the collector electrode of the transistor 221. A photosensitive device 223*b* constituting a photocoupler 223 together with the light-emitting diode 223*a* is connected through a rectifying circuit to the gate electrode of the bidirectional thyristor 225. If and when the control signal PO is obtained from the microprocessor 100 in such a situation, the transistor 221 is driven to saturation and accordingly the light-emitting diode 223*a* in the photocoupler 223 is turned on. As a result, the light-emitting diode 223*a* emits light during an on time period when transistor 221 is saturated, and the bidirectional thyristor 225 is rendered conductive responsive to the signal from the photosensitive device 223*b* during the above described on time period of the transistor 221. Thus, it would be appreciated that the magnetron tube 215 is controlled to be turned on or off responsive to the control signal PO obtained from the microprocessor 100. The microprocessor 100 is further connected at a reset terminal RESET to a reset circuit 229. The reset circuit 229 comprises a capacitor 229*a* and a diode 229*b*. Upon turning on of the voltage source, the voltage $-V_1$ is obtained from the voltage source circuit 217 and the capacitor 229*a* is charged, whereby the microprocessor 100 receives through the reset terminal RESET the voltage $-V_1$ as charged in the capacitor 229*a*, whereby the microprocessor 100 is controlled to be reset. The diode 229*b* serves to discharge the capacitor 229*a*, when the voltage source is turned off. The microprocessor 100 is further connected through a terminal F3 to a buzzer driving circuit 231 for driving a buzzer 233 serving as an alarming means. If and when a signal BZ is obtained from the terminal F3 as a high level voltage, the buzzer driving circuit 231 is enabled, whereby the buzzer 233 is energized.

The door switch described in conjunction with FIG. 1 is denoted as 227 in FIG. 2. Accordingly, if and when the door 4 shown in FIG. 1 is closed, the signal DOR is applied to the terminal B1 of the microprocessor 100.

Figure 3A:
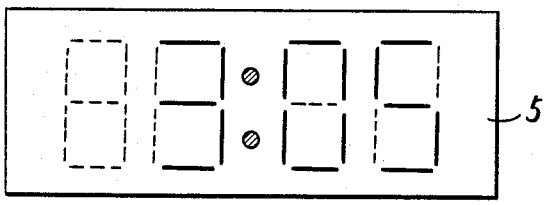
FIG. 3A shows a preferred manner for displaying the current time.
Figure 3B:
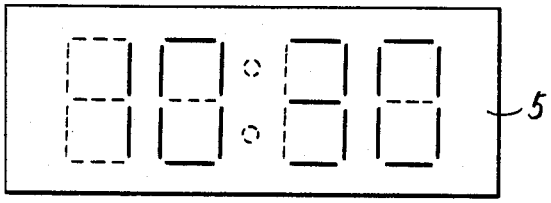
FIG. 3B shows a preferred manner for displaying a cooking time period.

FIGS. 3A and 3B show examples of display by the above described display means 5. The display means 5 may comprise well-known fluorescent segment type numeral display tubes and the embodiment is shown as comprising four numeral display positions and a colon display position. More specifically, FIG. 3A shows an example of displaying the current time, wherein five minutes past three o'clock is displayed as "3:05" with an indication of the colon mark between the two more significant numeral positions and the two less significant numeral positions. On the other hand, FIG. 3B shows an example showing a remaining time period of a predetermined cooking time period on the occasion of a timed cooking operation, without indication of the colon mark, wherein a remaining time period of ten minutes and thirty seconds is indicated as "1030". The display portion 5 is also used to display other information as entered from the above described data entry means 6.

FIG. 4 shows in detail the above described entry means 6. The data entry means 6 comprises ten numeral keys allotted for the ten numerals 0, 1, 2, ... 9, and eight function keys denoted as TIMER, POWER, CLOCK, CLEAR, RECIPE, START, STOP and QUANTITY. These keys may comprise ordinary push button switches of a contact closable type. The operation sequence and the function of these numeral keys and function keys will be described subsequently.

FIG. 5 shows in detail an electrical connection of a key matrix 60. The data entry means 6 comprises a plurality of keys as shown in FIG. 4 and the matrix 60 comprises a corresponding plurality of switches corresponding to these keys.

Upon receipt of the control signals SE2, SI0 and SE0 from the microprocessor 100, the first column line 61, the second column line 62 and the third column line 63 of these switches of the matrix 60 are supplied with the potentials of these signals SE2, SI0 and SE0, respectively. On the other hand, the first to sixth row lines 64 to 69 of these switches of the matrix 60 are connected to an encoder 601, which is structured to convert the signals at these row lines to a three-bit coded signal, thereby to provide an input data signal of three bits SA0, SA1 and SA2.

Accordingly, depression of any key is detected on the occasion of generation of any of the key control signals SE2, SI0 and SE0 and a coded input data signal of three bits SA0, SA1, and SA2 corresponding to the depressed key is obtained. A correlation between these keys and the input data signals is shown in FIG. 6A. As seen from FIG. 6A, each one of the input data signals is shown allotted to three kinds of keys; however, the microprocessor 100 is adapted to discriminate these three keys allotted to each one of the input data signals as a function of synchronization with the control signals SE2, SI0 and SE0. The above described input data signals are treated in the microprocessor 100 as a binary coded decimal (BCD) code signal and a correlation between the input data signals and thus the keys and the BCD codes is shown in FIG. 6B.

The above described display portion 5 comprises the well-known fluorescent segment type numeral display tubes and a driver circuit thereof. For the purpose of dynamic driving of the display means 5, the digit selecting signal SE0 obtained from the microprocessor 100 selects the first digit, the digit selecting signal SE1, obtained from the microprocessor 100 selects the second digit, the digit selecting signal SE2 obtained from the microprocessor 100 selects the third digit, and the digit selecting signal SE3 obtained from the microprocessor 100 selects the fourth digit, while the segment selecting signals SD1 to SD7 obtained from the microprocessor 100 are used to select corresponding segments of the respective digits. Accordingly, if and when the segment selecting signals SD1, SD3, SD4, SD5 and SD7 are obtained while the digit selecting signal SE0 is obtained, it follows that the numeral "2" is displayed at the first digit, for example, and so on. The display means 5 is further structured such that the digit selecting signal SI0 selects the colon digit and the segment selecting signal SD6 drives the colon digit, so that the colon may be displayed as a function of both signals SI0 and SD6.

Figures 7, 9A, 9B:
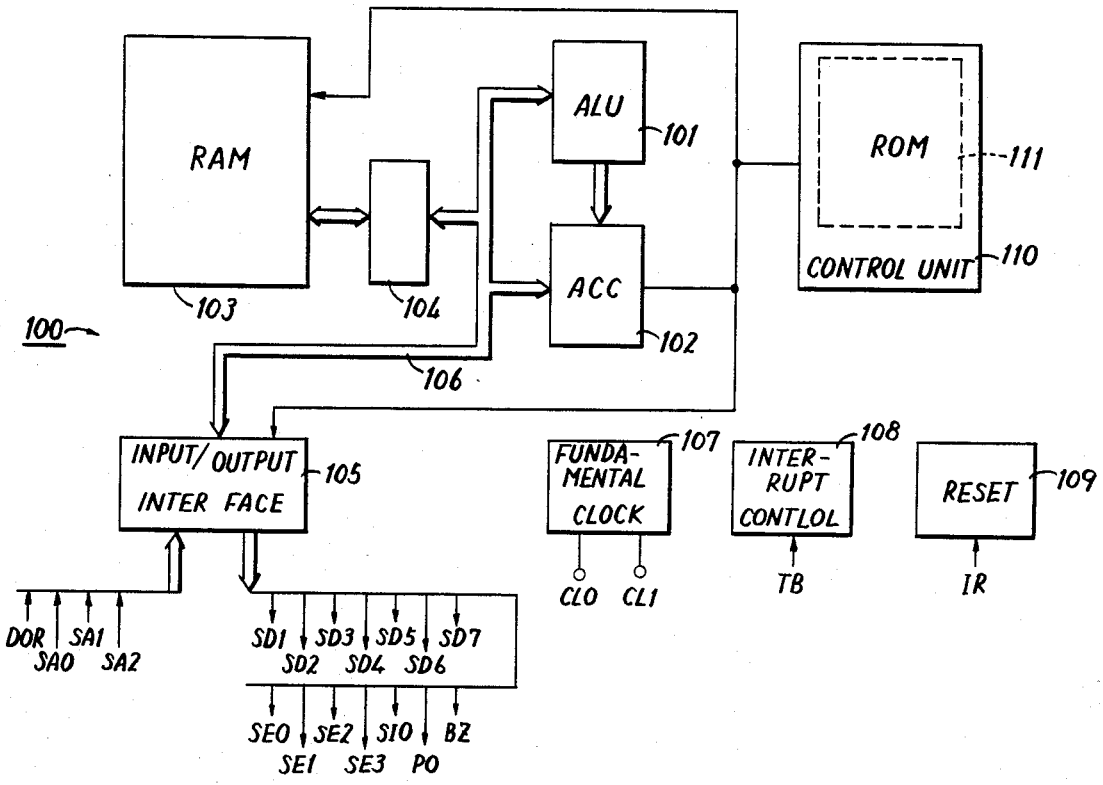
FIG. 7 is a block diagram of a microprocessor employed in a preferred embodiment of the present invention.
FIGS. 9A and 9B diagrammatically show storing regions of a random access memory included in the microprocessor.

FIG. 7 shows a block diagram of the microprocessor 100, which comprises a control unit 110, an arithmetic unit 101, an accumulator 102, a random access memory 103, a random access memory buffer 104, an input/output interface 105 and the like, and a data bus 106 for communication of information between these blocks. The control unit 110 serves to control communication of the information within these blocks. External input signals SA0, SA1, SA2, DOR and external output signals SD1 to SD7, SE0 to SE3, SI0, PO and BZ are inputted and outputted through the input/output interface 105.

The microprocessor 100 further comprises a reference clock signal generator 107, an interrupt control unit 108 and a reset unit 109. The reference clock signal generator 107 cooperates with an external component shown in FIG. 2 to generate a reference clock signal of 400 kHz and the interrupt control unit 108 is structured to be responsive to a time base signal TB to command an interrupt operation for a necessary timing operation. The reset unit 109 is structured to be responsive to the reset signal IR to command a necessary reset operation.

The control unit comprises a read only memory 111 for storing a control program and various constants, a program counter, not shown, for performing the progress of steps of the above described control program, and a command decoder, not shown, for decoding various commands read at the respective steps for performing the tasks.

The read only memory 111 is also structured to store a program for fixed cooking modes. Such fixed cooking program is aimed to perform nine kinds of recipes as identified as Nos. 1 to 9. Table I shows the cooking conditions of the recipes Nos. 1 and 2, among the recipes Nos. 1 to 9; however, it should be understood that similar but different cooking conditions have been determined to the remaining recipes Nos. 3 to 9 as well.

TABLE I

| | cooking conditions | |
|---|---|---|
| recipes | heating energy intensity | fixed cooking time |
| 1 | 80% | 3 minutes |
| 2 | 50% | 10 minutes |

Now assuming that the recipe No. 1 is selected by operation of the data entry means 6, heat cooking is automatically performed under the cooking conditions of 80% heating energy intensity (relative to the maximum microwave output) and fixed cooking period of three minutes. A program of such cooking conditions as stored in the read only memory 111 is shown in FIG. 10M, taking an example of recipe No. 1 representing the remaining recipes. It is pointed out that the cooking conditions of each of the above described recipes is that for a unit quantity, say 200 g, of a material to be cooked.

Figure 8:
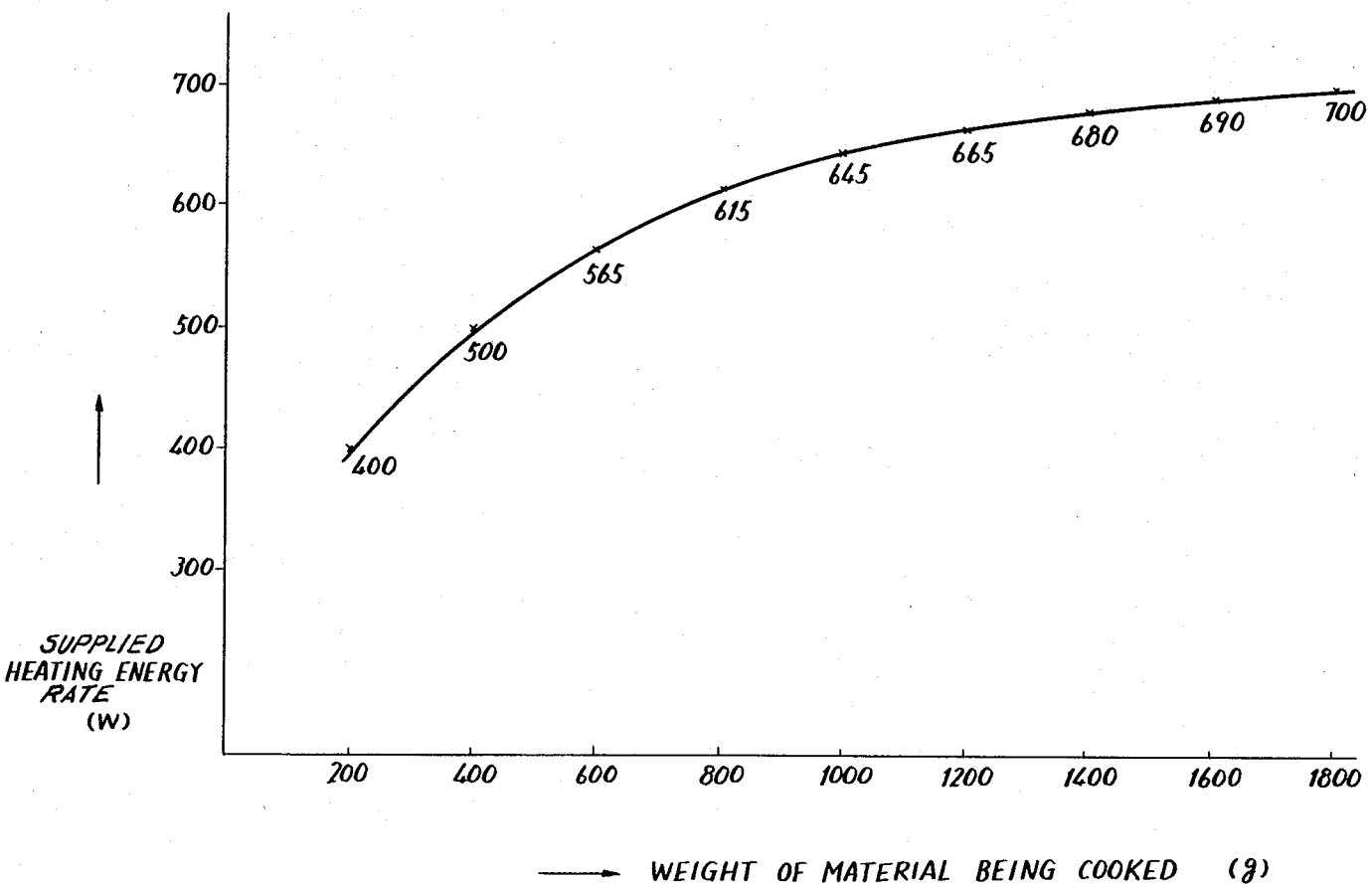
FIG. 8 is a graph showing a relation between the weight of a material being cooked and the amount of microwave energy supplied to the material, in the case where the material to be cooked is water.

The read only memory 111 further stores a coefficient program concerning the gross weight of a material being cooked in accordance with the above described fixed cooking program. It has been observed that, in the case of a microwave oven, conditions in the cooking chamber 2 (FIG. 1) change depending on the gross weight of a material being cooked. An impedance matching condition between the cooking chamber 2 and the microwave source such as a magnetron tube 215 is accordingly changed, whereby a supply of microwave energy from the magnetron is accordingly changed. FIG. 8 shows a correlation between the gross weight of a material being cooked and the amount of microwave energy supplied to a material being cooked. In particular, FIG. 8 shows such a relation obtained in the case where magnetron Model 2M-172 (nominal output 600 W) manufactured by Nippon Electric Company Limited is used as a microwave source and the output therefrom is supplied to a cooking chamber of 374 mm in width, 414 mm in depth and 248 mm in height, in which a cup of water is placed by way of a typical material being cooked. An amount of microwave energy supplied per unit time was obtained by an increase of the water temperature by virtue of microwave heating, while the volume of water is changed to various values.

Referring to FIG. 8, it is seen that in the case where the gross weight of a material being cooked is increased from 200 g and to 800 g a supply amount of microwave energy per unit time becomes 400 W and 615 W, respectively. This means that when the gross weight of a material being cooked is increased by four times an increase of cooking time by four times is totally improper. More specifically, an energy supply amount W1 to be supplied to a material being cooked when a material of 200 g is heated for a time period of T1 is evaluated as $W1=400\times T1$ and accordingly, in order to achieve the same degree of cooking with respect to a material of 800 g, the gross energy supply amount W2 required for the material of 800 g must be 4W1, inasmuch as the material is increased by four times. On the other hand, referring to FIG. B, assuming T2 is the heating time period necessary for the material to receive the energy supply amount of 4W1, then $W2=615\times T2$ and accordingly the equation T2=2.6T1 is obtained. Thus, it would be appreciated that when a material is increased by four times from 200 g to 800 g, it is sufficient to increase the cooking time period by 2.6 times as compared with that in case of 200 g. Table II shows an expansion coefficient of a cooking time period for various increased weights of a material being heated with respect to a unit quantity of 200 g.

TABLE II

| weight (g) | coefficient | weight (g) | coefficient |
|---|---|---|---|
| 200 (reference) | 1 | 1200 | 3.6 |
| 400 | 1.6 | 1400 | 4.1 |
| 600 | 2.1 | 1600 | 4.6 |
| 800 | 2.6 | 1800 | 5.1 |
| 1000 | 3.1 | | |

In the embodiment of the invention the above described coefficients are commonly applied to all of the recipes Nos. 1 to 9 in the above described fixed cooking program. Alternatively, a different coefficient table may be prepared for each of the recipes; however, in view of the fact that the microwave energy is mainly absorbed in the water contained in a material being cooked in every recipe, such common application would be practical.

In the above described emdoiment the material weight of 200 g is deemed as a unit quantity, and material weights up to 1800 g are divided into nine weight ranges in accordance with the above described Table II. More specifically, the embodiment is structured such that by selecting the weight ranges among 1 to 9 by means of the data entry means 6 a prescribed expansion coefficient is read out from the read only memory 111 and the fixed time period is automatically changed based on said coefficient. FIG. 10N shows such a coefficient program stored in the read only memory 111, by taking a typical example of the case where the weight range is 2, i.e. the weight is 400 g.

The random access memory 103 is used to store various kinds of data. FIG. 9A shows a diagram of storing areas of the random access memory 103. The storing areas of the random access memory 103 contain 0 to 3 pages, each page containing the addresses of sixteen digits 0 to 9 and A to F, so that any particular storing area can be accessed by addressing of these pages and digits. To that end, the random access memory 103 also comprises an address register. Each of the digits 0 to 9 and A to F of the random access memory 103 comprises a four-bit length. Each of the areas denoted as "DISPLAY", "TIMER", "TIMER B", and "CLOCK" is of a four-digit length, so that a decimal number may be stored in one digit position as a binary coded decimal code. Each of the areas as denoted as "CNT1", "CNT2" and "QK" is of a two-digit length, so that a decimal number may be stored in one digit position as a binary coded decimal code. Each of the areas as denoted as "PWR A", "PWR B", "POWER", "RECIPE", "QUANTITY", "CNT 3", and "NKB" is of a one-digit length so that a decimal number may be similarly stored as a binary coded decimal code. The area as denoted as "FKB" is of a one-digit length, so that information may be stored as a four-bit code. Each of the areas as denoted as "KNF" and "RF" is of a one-digit length, the bit structure thereof is shown in FIG. 9B. The control unit 110 serves to perform a control operation as a function of the data stored in the random access memory 103 and a program prepared and stored for that purpose in the read only memory 111 is shown in FIGS. 10A to 10N.

Figure 10A:
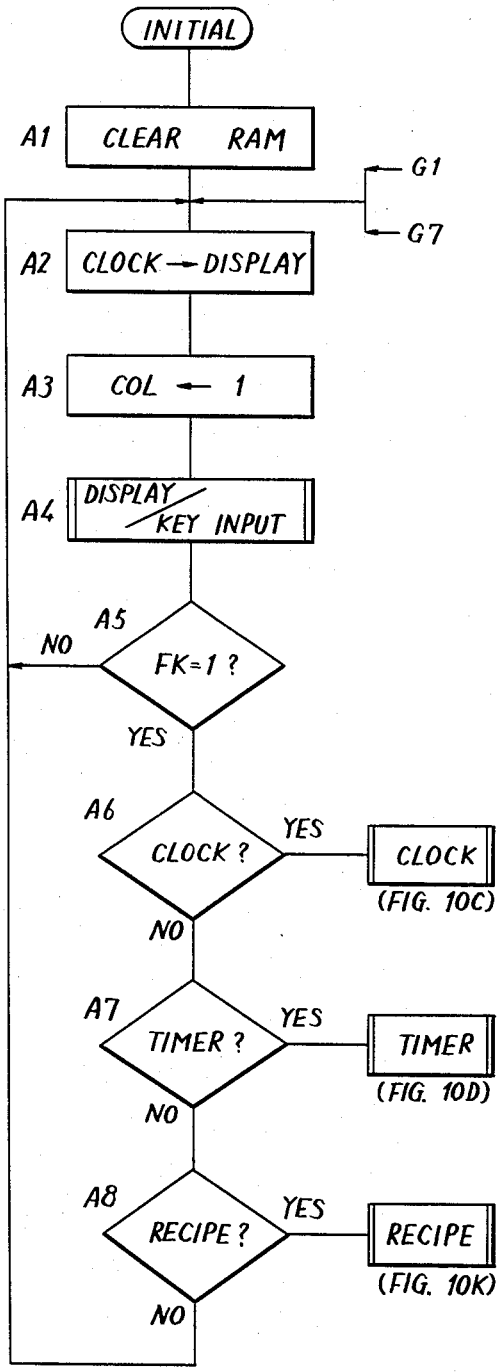
FIGS. 10A to 10N are flow diagrams showing an example of a program of the microprocessor.
Figure 10B:
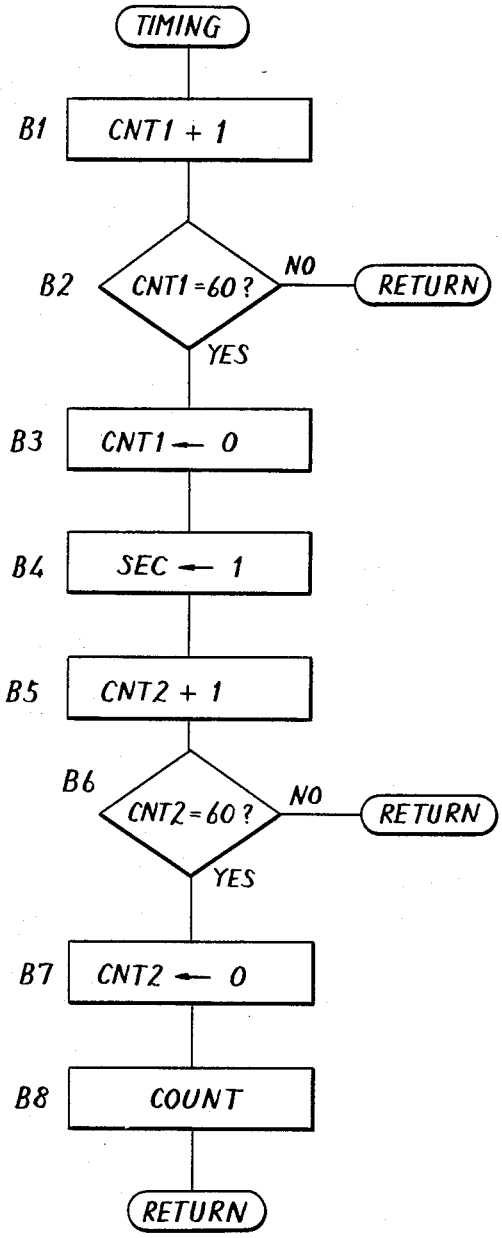
Figure 10D:
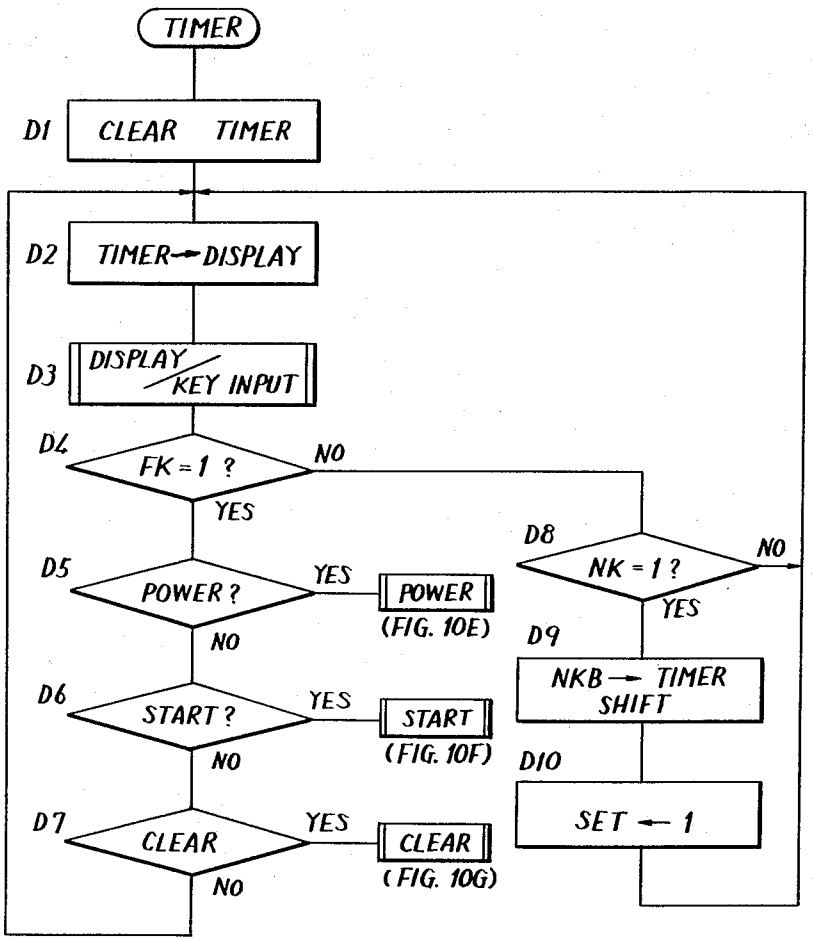
Figure 10C:
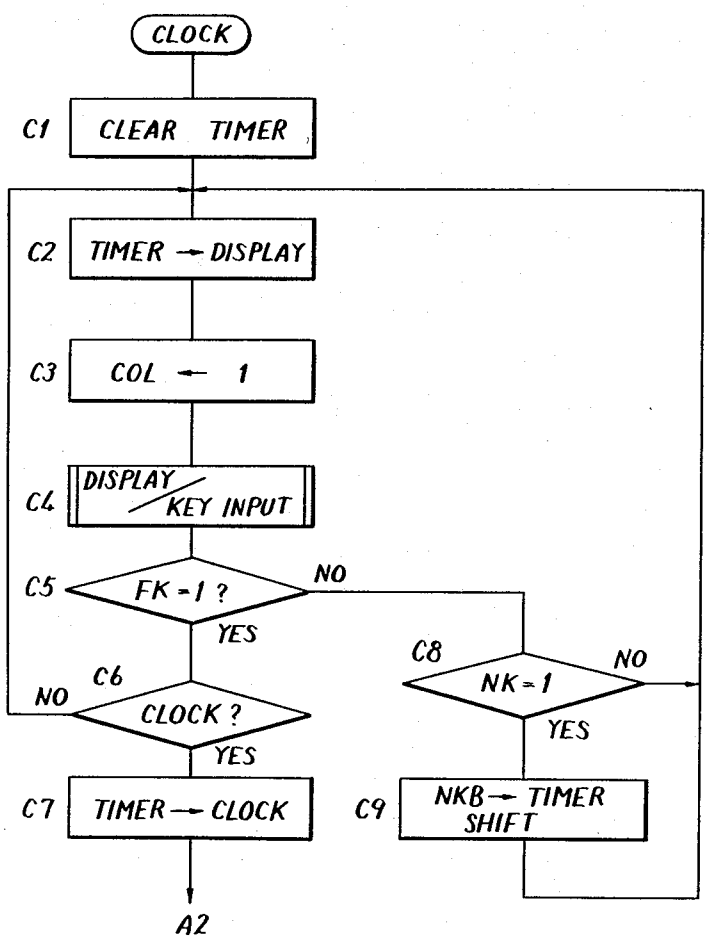
Figure 10E:
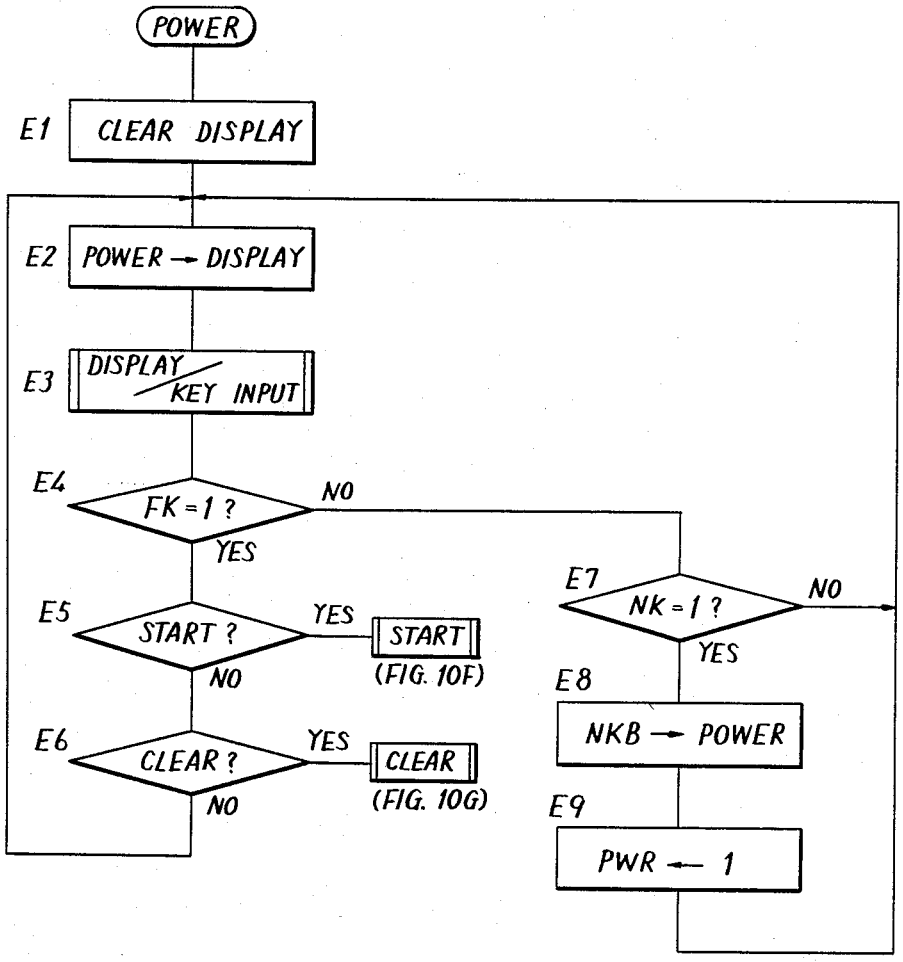
Figure 10G:
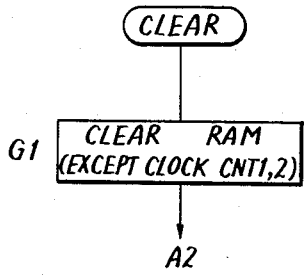
Figure 10H:
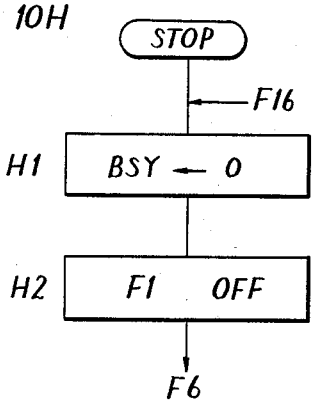
Figure 10F:
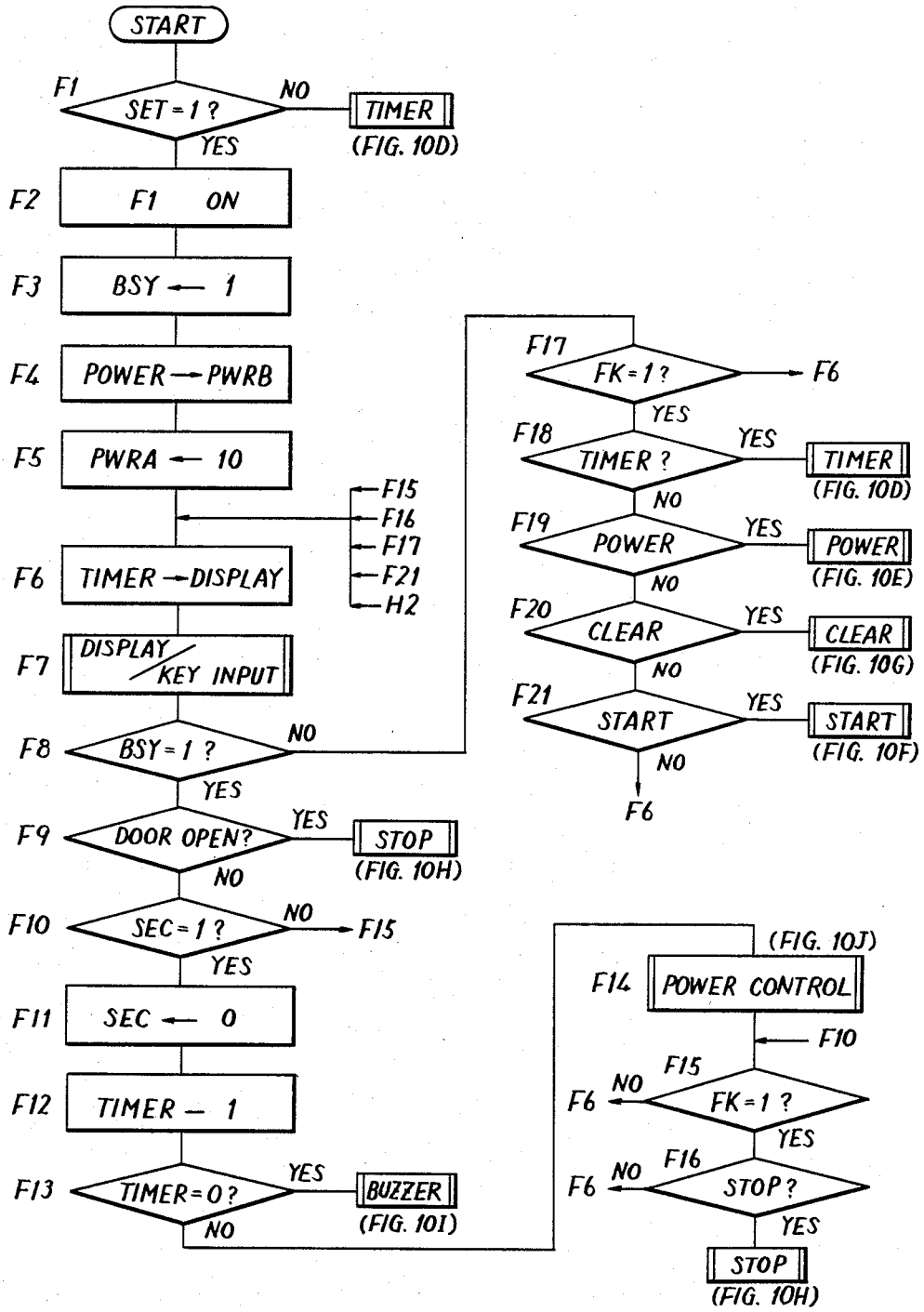
Figure 10I:
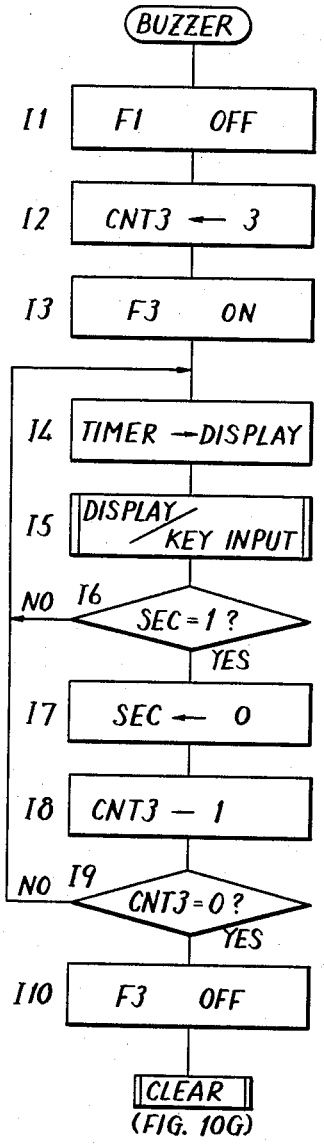
Figure 10J:
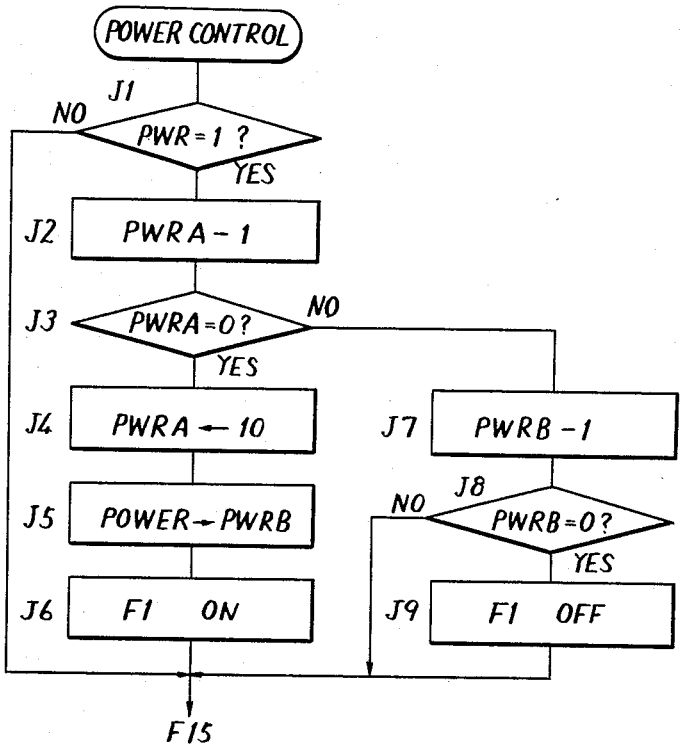
Figures 1, 10K:
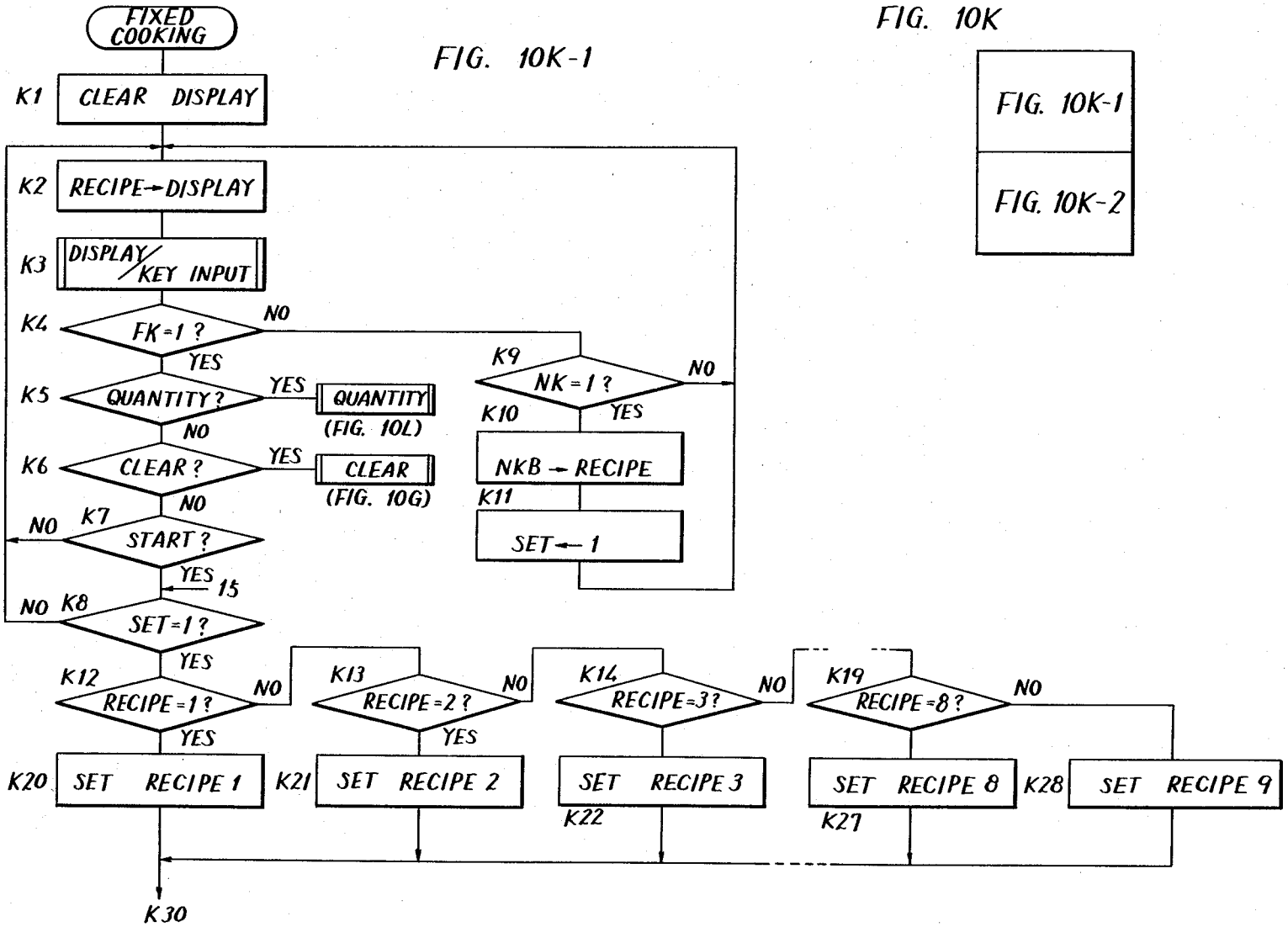
Figures 2, 10K:
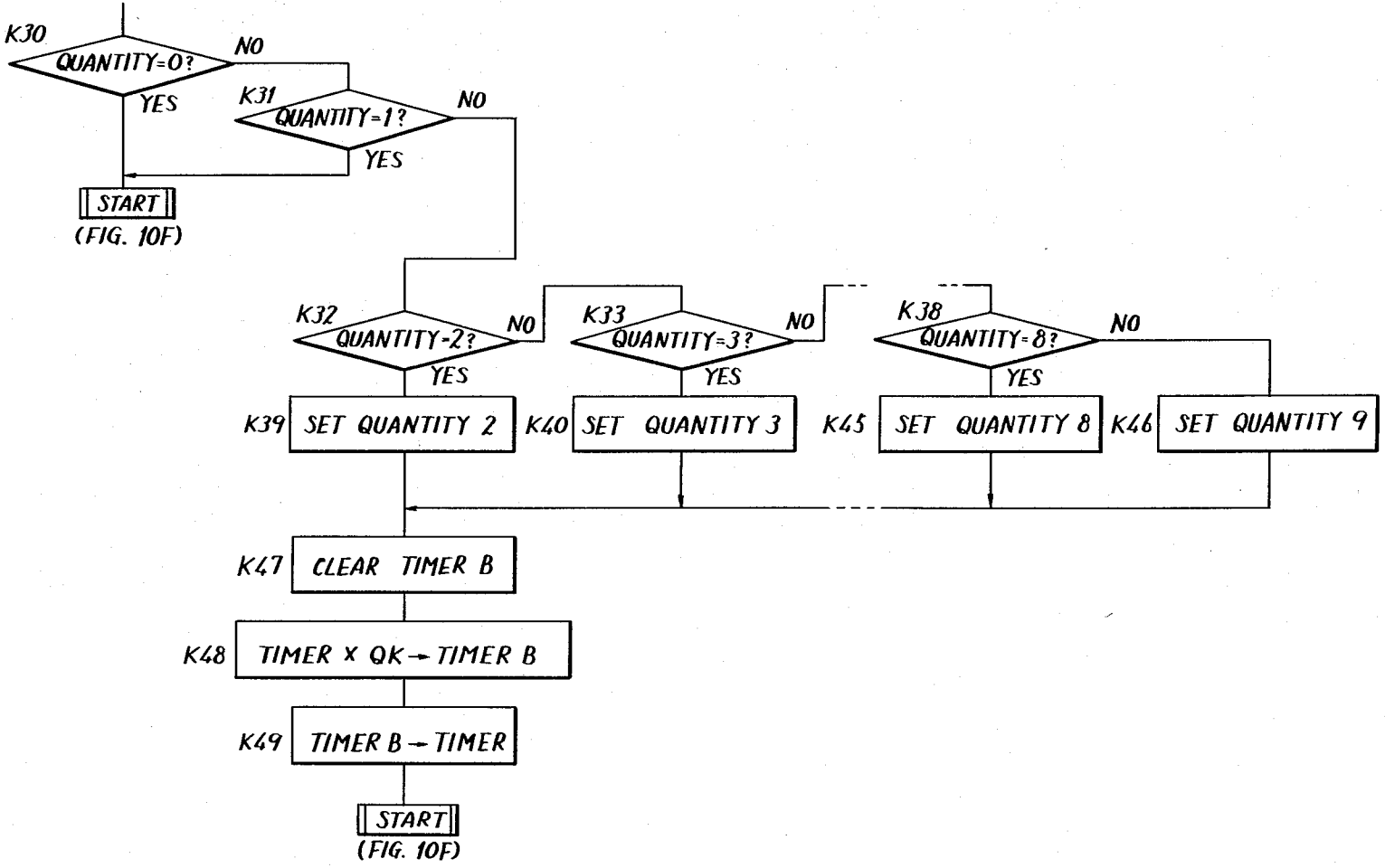
Figure 10L:
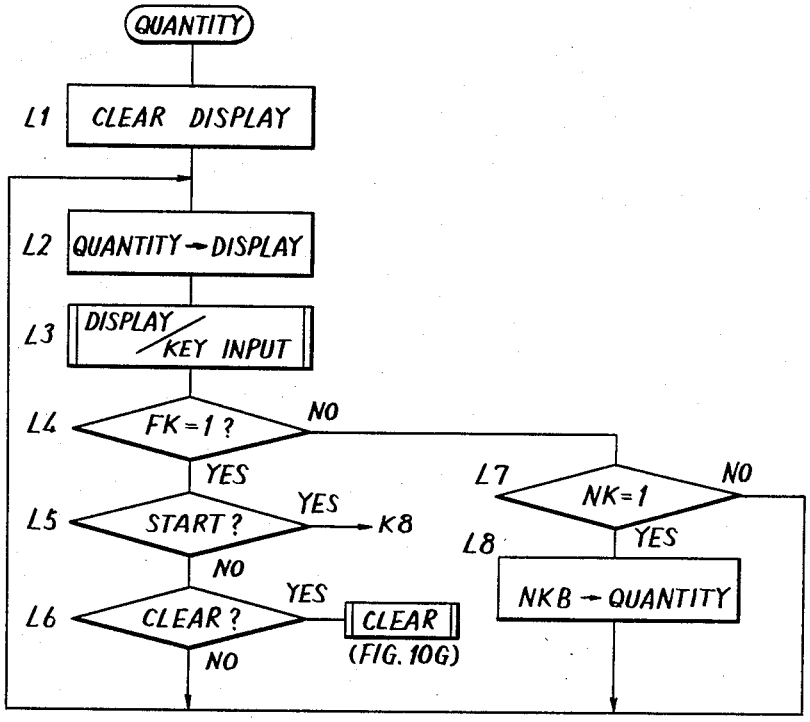
Figure 10M:
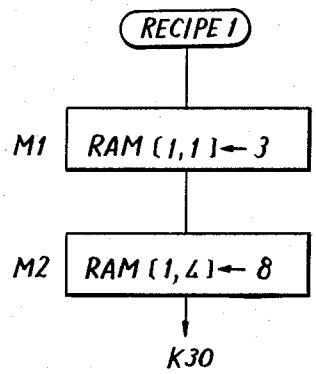
Figure 10N:
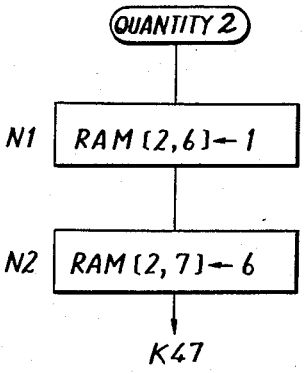

Referring to FIGS. 10A to 10N, various functions of a microwave oven in accordance with one embodiment of the present invention will be described. It is pointed out that in the following description each address of the random access memory 103 is denoted as page, digit for simplicity and accordingly, 2,3 represents the address of page 2, digit 3, for example. Similarly, the microprocessor 100, the read only memory 111 and the random access memory 103 are simply referred to as the microprocessor, the read only memory, and the random access memory, respectively, for simplicity of description in the following.

START OF ENERGIZATION

At the beginning of energization of the microwave oven, an initial condition setting signal IR described with reference to FIG. 2 is applied to the microprocessor, so that the microprocessor is automatically brought to the step A1 of an initial routine (FIG. 10A).

At the step A1 the logic zero is loaded in all the storing areas of the random access memory, thereby to clear all the contents in the random access memory. Then the routine sequentially proceeds to the steps A2 and A3. At the step A2 the data in the area "CLOCK" of the random access memory is transferred to the area "DISPLAY" in preparation for display of the current time. At the step A3 the logic one is loaded in the area "COL" in preparation for display of the current time.

The program then proceeds to the step A4, wherein the microprocessor sequentially generates the digit selecting signals SE0 to SE3 and SI0, and the functions of display, key detection and colon reset are performed.

On the occasion of the above described display function, the data in the respective addresses of the first to fourth digits in the area "DISPLAY" of the random access memory i.e. 0,3, 0,2 0,1 and 0,0 of the random access memory is sequentially read out in synchronism with generation of the digit selecting signals SE0 to SE3. Said data is thereupon converted into a seven-bit code signal and is withdrawn as the segment selecting signals SD1 to SD7. On the occasion of generation of the digit selecting signal SI0 the data in the area "COL" of the random access memory is evaluated and, if and when the same is the logic one, the segment selecting signal SD6 is generated.

Accordingly, at the step A4 the data in the area "DISPLAY" of the random access memory is displayed in a time sharing fashion by the display means 5. In the case of the operation to be discussed, the data in the area "CLOCK" becomes the data in the area "DISPLAY" and the colon mark is displayed, so that the current time is displayed; however, at the beginning of energization, since the data in the area "CLOCK" has been cleared, the display means 5 indicates "00:00".

On the other hand, since the digit selecting signals SE0, SE2, and S10 at the above described step A4 have been applied to the key matrix 60, an operation of any keys of the data entry means 6 at that time causes the corresponding external input signals SA0, SA1 and SA2 to be entered into the microprocessor.

Such internal input signal is analyzed by the microprocessor, so that if and when the external input signal is of the numeral keys the logic one is loaded in the area "NK" of the random access memory and the external input signal of three bits is converted into a binary coded decimal code in accordance with the conversion table shown in FIG. 6B and the converted code is loaded in the area "NKB". If and when the external input signal is of the function keys, the logic one is loaded in the area "FK" of the random access memory and the external input signal is similarly converted into a four-bit code in accordance with the conversion table shown in FIG. 6B, which converted code is loaded in the area "FKB" of the random access memory.

As better understood from the subsequent description, the step A4 constitutes one step comprising a recirculation loop of the program, while a key operation is manually performed. The key operation time period is sufficiently long as compared with the step progressing time period of the program that the step A4 is performed several times during manual operation of a key. Upon operation of a key, the microprocessor loads the logic one in the area "KE" of the random access memory at the first performance of step A4 for analysis of the external input signal, whereby the second and further performance of the stp is discriminated from the first performance of the step A4. More specifically, the microprocessor analyzes the data in the area "KE" in the step A4, such that if and when the same is the logic one, then in spite of the fact that the key is still being operated, determination is made that such key operation is the same as the key operation determined at the first performance of the step A4, whereupon the logic zero is loaded in the area "FK" and the area "NK" of the random access memory. If and when no key is operated at the step A4, then the logic zero appears in the respective areas "FK", "NK" and "KE" of the random access memory. At the step A4, the logic zero is further loaded in the area "COL" of the random access memory after a period of generation of the above described control signal SI0, whereupon the colon reset function is performed. After the step A4, the program proceeds to the step A5.

At the step A5, the kind of the key operated at the step A4 is determined as to whether or not the operated key is a function key. More specifically, the data in the area "FK" in the random access memory is determined and if and when the same is determined as the logic zero the program is caused to proceed to the step A2, whereas if and when the same is determined as the logic one the program is caused to proceed to the step A6. In the operation now in discussion, it has been assumed that no key is depressed at the step A4 and accordingly the program is caused to return to the step A2. Thereafter, unless a function key is operated, the program is caused to circulate the steps A2, A3, A4 and A5.

UPDATE FUNCTION

Upon application of the time base signal TB to the terminal INT, the microprocessor interrupts all the processes at that time point and instead performs an update function by a timing routine shown in FIG. 10B, after which the program again returns to the step which was being performed on the occasion of the above described interruption.

The timing routine is aimed to renew the current time of the area "CLOCK" of the random access memory by generating a second signal and a minute signal through a counting operation of the number of the time base signals TB received (at a frequency of 60 Hz), and by utilizing such minute signal. At the first step B1 of the timing routine, "1" is added to the data in the area "CNT1" of the random access memory, whereupon the data in the area "CNT1" is determined at the following step B2. Unless the data in the area "CNT1" is determined as equal to "60", the program is caused to return to the step which was being performed on the occasion of the above described interruption, whereas if and when the data in the area "CNT1" is determined as equal to "60" the program is caused to proceed to the step B3. Thus, a shift to the step B3 means the lapse of one second.

At the step B3, "0" is loaded in the area "CNT1" and at the following step B4 the logic one is loaded in the area "SEC" of the random access memory, whereby the lapse of one second is stored. The program then shifts to the following step B5.

At the step B5, "1" is added to the data in the area "CNT2" of the random access memory and at the following step B6 the data in the area "CNT2" is determined. Unless the data in the area "CNT2" is determined as equal to "60", the program is caused to return to the step which was being performed on the occasion of the above described interruption, whereas if the data in the area "CNT2" is determined as equal to "60" the program is caused to proceed to the step B7. A shift of the program to the step B7 means the lapse of one minute.

At the step B7, "0" is loaded in the area "CNT2" and at the following step B8 "1" is added to the data in the area "CLOCK" of the random access memory. At that time, a carry from the first digit 3,3 to the second digit 3,2 in the area "CLOCK" is made in a decimal fashion, a carry from the second digit to the third digit 3,1 is performed in base six, and a carry from the third digit to the fourth digit 3,0 is performed in the decimal fashion, respectively. If and when said "1" is added in such a situation where the data in the area "CLOCK" is 59 minutes past 12 o'clock, the data in the area "CLOCK" updates to a state of indication of zero minutes past one o'clock. The program then returns to the step which was being performed on the occasion of the above described interruption.

Thus it would be appreciated that in accordance with the timing routine an update function is performed based on the time base signal TB, so that the data in the area "CLOCK" of the random access memory is renewed to the current time.

As is clear from the foregoing description of START OF ENERGIZATION and UPDATE FUNCTION, upon energization of the microwave oven, all the areas of the random access memory are first cleared whereupon an update function is performed using the area "CLOCK" of the random access memory, while the data of the area is displayed by the display portion 5. In the above described case, no initial setting of the data in the area, "CLOCK" has been made and therefore a time period that lapsed from the above described energization is displayed by the display means 5.

TIME SETTING

In order to effect setting of a time display by the display means 5, the CLOCK key of the data entry means 6 is used. Assuming that the time is to be set to just two o'clock, the keys are operated in the following sequence.

C L O C K 2 0 0 CLOCK

In the following the progress of the program in accordance with the above described key operation sequence will be described.

As described previously, the program is circulating the steps A2 to A5 of the initial routine. Accordingly, upon operation of the CLOCK key, the key operation is determined by the step A5, so that the program proceeds to the step A6. At the step A6, the data in the area "FKD" of the random access memory is determined as to whether the above described operated key is the CLOCK key. Since in the above described instance the depressed key is the CLOCK key, the program shifts to the clock routine (FIG. 10C).

At the first step C1 of the clock routine, the logic zero is loaded in all of the area "TIMER" of the random access memory, whereby the data therein is cleared, whereupon the program sequentially proceeds to the steps C2 and C3. At the step C2 the data in the area "TIMER" is transferred to the area "DISPLAY" and at the step C3 the logic one is loaded in the area "COL" in preparation for display of the current time.

The program then sifts to the step C4, wherein exactly the same process as that of the step A4 of the initial routine is performed, whereupon the program shifts to the step C5.

At the step C5 the data in the area "FK" of the random access memory is determined. If the same is determined as the logic zero the program shifts to the step C8, whereas if the same is determined as the logic one the program shifts to the step C6. Since the key operation time period is sufficiently long as compared with the progress of the steps of the program by means of the microprocessor, the key operated state is already stored in the area "KE" of the random access memory at the beginning of the clock routine, which is initiated responsive to the operation of the above described CLOCK key. Therefore, on the occasion of departure from the step C4, the data in the area "FK" and the area "NK" is the logic zero. Accordingly, the program shifts to the step C8. At the step C8 the data in the area "NK" of the random access memory is determined. If the same is determined as the logic zero the program shifts to the step C2. whereas if the same is determined as the logic one the program shifts to the step C9.

Since the data in the area "NK" of the random access memory is the logic zero at the moment, the program thereafter recirculates through the steps C2 to C5 and C8. If and when the above described CLOCK key is released from being depressed in the course of the above described recirculation, the data in the area "KE" becomes the logic zero and it follows that further key operation is determined by the step C4.

If an when further key operation is of the numeral key "2", then such key operation is determined at the above described step C4, whereby the program proceeds to the steps C5, C8 and C9. At the step C9 the data in the respective digit positions in the area "TIMER" of the random access memory is shifted by one digit toward the more significant digit, while the data in the area "NKB" of the random access memory is loaded in the first digit position 1,3 of the area "TIMER", whereupon the program shifts to the step C2.

Accordingly, until further key operation, the program makes recirculation of the respective steps C2, C3, C4, C5 and C8, while the data in the area "TIMER" is displayed in the course of the above described recirculation. More specifically, the data "00:02" is displayed at that time.

Similarly thereafter, if and when key operation is made of the numeral keys "0" and "0", a display state "02:00" representing two hours zero minutes by way of a set time period is displayed by the display means 5, whereupon the program makes recirculation of the respective steps C2, C3, C4, C5 and C8.

Finally when the CLOCK key is again operated, such key operation is determined by the step C4, so that the program shifts through the step C5 to the step C6. At the step C6 it is determined whether the currently operated key is the CLOCK key by determining the data in the area "NKB" of the random access memory. If the key operation is not determined as the CLOCK key, then the program proceeds to the step C2, and otherwise the program shifts to the step C7.

At the step C7, the data in the area "TIMER" of the random access memory is transferred to the area "CLOCK", whereupon the program thereafter recirculates the respective steps A2 to A5 of the initial routine.

Accordingly, if and when the above described second operation of the CLOCK key is operated just at the time point of two o'clock, the data in the area "CLOCK" of the random access memory is replaced with the lapse of time starting from two o'clock, whereby a correct current time is displayed by the display means 5.

TIMER OPERATION

Assuming that the microwave oven is operated at the 50% heating energy intensity relative to the maximum microwave output for ten minutes, then key operation is made in the following order by means of the data entry means 6.

T I M E R 1 0 0 0 P O W E R 5-
S T A R T

In the following the progress of the program in accordance with the above described key operation sequence will be described.

The program has been recirculating the respective steps A2 to A5 of the initial routine, as described previously. Accordingly, when the TIMER key is operated, such key operation is determined at the step A4, whereupon the program shifts through the steps A5 and A6 to the step A7. At the step A7 the data in the area "FKB" of the random access memory is analyzed, whereby it is determined whether the above described key operation is of the TIMER key. Since the key operation is of the TIMER key at that time, the program shifts to the timer routine (see FIG. 10D).

At the first step D1 of the timer routine, the logic zero is loaded in all the area "TIMER" of the random access memory, whereby the area is cleared, whereupon the program sequentially shifts to the steps D2 and D3. At the step D2, the data in the area TIMER of the random access memory is transferred to the area "DISPLAY", and at the step D3 exactly the same process as that of the step A4 of the initial routine is performed, whereupon the program shifts to the step D4.

At the step D4, the data in the area "FK" of the random access memory is determined and, if the same is the logic zero, the program shifts to the step D8, whereas if the same is determined as the logic one, the program shifts to the step D5. At the step D8, the data in the area "NK" of the random access memory is analyzed and, if the same is determined as the logic zero, the program shifts to the step D2, whereas if the same is determined as the logic one, the program shifts to the step D9.

On leaving the above described step D3, the data in the respective areas "FK" and "NK" of the random access memory is the logic zero, unless further key operation is made, and therefore the program recirculates the respective steps D2, D3, D4 and D8, so that "0000" is displayed by the display portion 5.

If and when further key operation is made of the numeral key "1", such key operation is determined by the above described step D3 and the program returns to the step D2 through the respective steps D4, D8, D9 and D10. At the step D9 the data in the respective digit positions of the area "TIMER" of the random access memory is shifted by one digit toward the more significant digit, while the data in the area "NKB" of the random access memory is loaded in the first digit position 1,3 of the area "TIMER". At the step D10 the logic one is loaded in the area "SET" of the random access memory, whereby it is stored that the timer numerical value of at least one digit is entered.

Thereafter the program makes again recirculation of the respective steps D2, D3, D4 and D8 until further key operation, while the data in the area "TIMER" is displayed in the course of the above described recirculation.

Similarly thereafter, upon further key operation of the numeral keys "0", "0", "0", an indication "1000" representing ten minutes of a timer set time is displayed by the display means 5, whereupon the program recirculates the respective steps D2, D3, D4 and D8.

Thereafter, upon further key operation of a function key, the program returns to the step D2 through the respective steps D5, D6 and D7. At the respective steps D5, D6 and D7, the data in the area "FKB" of the random access memory is analyzed to see whether the same is of the POWER key, the START key or the CLEAR key, and if the same is of any of them, immediately the program returns to the power routine (FIG. 10E), the start routine (FIG. 10F), or the clear routine (FIG. 10G), respectively.

Since new key operation in the sequence described is of the POWER key, the program shifts to the power routine. At the first step E1 of the power routine the logic zero is loaded in the area "DISPLAY" of the random access memory, whereby the data therein is cleared, whereupon the program shifts in succession to the respective steps E2 and E3. At the step E2, the data in the area "POWER" is transferred to the area "DISPLAY". At the step E3, exactly the same process as that of the step A4 of the initial routine is performed, whereupon the program shifts to the step E4.

At the step E4 the data in the area "FK" of the random access memory is determined and if the same is determined as the logic zero the program shifts to the step E7, whereas if the same is determined as the logic one the program shifts to the step E5. Furthermore, at the step E7 the data in the area "NK" of the random access memory is analyzed and if the same is determined as the logic zero the program shifts to the step E2, whereas if the same is determined as the logic one the program shifts to the step E8.

Since upon leaving the above described step E3 the data in the respective areas "FK" and "NK" of the random access memory is the logic zero unless further key operation is made, the program recirculates the respective steps E2, E3, E4 and E7, whereby the data "0000" is displayed by the display means.

Now assuming that further key operation is made of the numeral key "5", such key operation is determined by the above described step E3 and the program returns to the step E2 through the respective steps E4, E7, E8 and Eg. At the step E8 the data in the area "NKB" of the random access memory is loaded in the area "POWER" of the random access memory. At the step E9 the logic one is loaded in the area "PWR" of the random access memory, whereby the fact that the heating energy intensity has been set is stored.

Thereafter the program again recirculates the respective steps E2, E3, E4 and E7 until further key operation is made, while the data in the area "POWER" is displayed during the above described recirculation. More specifically, an indication "0005" representing the 50% heating energy intensity is displayed by the display means 5 at that time.

If and when further key operation is thereafter made and the same is of a function key, then the program returns to the step E2 through the respective steps E5 and E6. At the respective steps E5 and E6, the data of the area "FKB" of the random access memory is determined to see whether the same is of the START key or the CLEAR key and if and when the same is of any of them the program immediately returns to the start routine (FIG. 10F) or the clear routine (FIG. 10G), respectively.

Since new key operation in the sequence described is of the START key at that time, the program shifts to the start routine.

At the first step F1 of the start routine the data in the area "SET" of the random access memory is analyzed to see whether the TIMER has already been set. More specifically, if and when the data in the area "SET" is the logic zero then the same is determined as not yet set and the program shifts to the timer routine, whereas if the data in the area "SET" is determined as the logic one the same is determined as already set and the program shifts to the step F2.

Since the data in the area "SET" is the logic one in this case the program shifts to the step F2 and at that step the signal PO is provided at the heat command output terminal F1 of the microprocessor. Therefore, at that time point the output of microwave energy is initiated and thereafter the output of microwave energy continues until after the above described signal PO disappears.

The program then shifts to the step F8 through the respective steps F3, F4, F5, F6 and F7. At the step F3 the logic one is loaded in the area "BSY" of the random access memory, thereby to store that microwave energy is being provided. At the step F4 the data in the area "POWER" of the random access memory is transferred to the area "PWR B". Accordingly, at that time "5" representing the 50% heating energy intensity is loaded in the area "PWR B". At the step F5 "10" is stored in the area "PWR A" of the random access memory. At the step F6 the data in the area "TIMER" of the random access memory is transferred to the area "DISPLAY" and at the step F7 exactly the same process as that of the step A4 of the initial routine is performed. Accordingly, in this case the data in the area "TIMER" is that representing the timer set time period being ten minutes and therefore at the step F7 an indication "1000" is made by the display means 5.

At the following step F8 the data in the area "BSY" of the random access memory is analyzed and if the same is determined as the logic one the program shifts to the step F9, whereas if the same is determined as the logic zero the program shifts to the step F17. At the step F17 the data in the area "FK" of the random access memory is determined. More specifically, unless further new key operation made thereafter is of a function key, immediately the program returns tohe step F6, whereas if the same is of a function key the program returns to the step F6 through the respective steps F18 to F21. At the respective steps F18 to F21 the data in the area "FKB" of the random access memory is determined to see whether the same is of the TIMER key, the POWER key, the CLEAR key, or the START key, and when the same is any of them, immediately the program shifts to the timer routine, the power routine, the clear routine or the start routine, respectively.

Since at the above described step F8 the data in the area "BSY" of the random access memory is the logic one, the program shifts to the step F9 and at that step it is determined whether the door 4 (FIG. 1) of the microwave oven has been opened or closed. More specifically, if the signal DOR has been applied to the terminal B1 of the microprocessor at that time point, it is determined that the door is closed and the program shifts to the step F10. On the other hand, if the signal DOR is not available at that time, the program shifts to the stop routine (FIG. 10H).

At the first step H1 of the stop routine the logic zero is loaded in the area "BSY" of the random access memory and at the following step H2 the signal PO at the heat command output terminal F1 of the microprocessor is made unavailable, whereby microwave oscillation is terminated. The program then returns to the step F6.

At the above described step F9 it is determined that the door 4 is closed at that time, whereby the program shifts to the step F10. At the step F10 lapse of the time in terms of seconds is determined. More specifically, the data in the area "SEC" of the random access memory is analyzed and if the same is determined as the logic zero then the program shifts to the step F19, whereas if the same is determined as the logic one the program shifts to the step F15 through the respective steps F11 to F14.

At the step F15 the data in the area "FK" of the random access memory is analyzed and if the same is determined as the logic zero the program returns to the step F6, whereas if the same is determined as the logic one the program shifts to the step F16. Accordingly, unless further new function key operation is made thereafter, the program makes recirculation of the respective steps F6 to F10 and F15, while the respective steps F11 to F14 proceed for every second in the above described recirculation.

At the step F16 the data in the area "FKB" of the random access memory is determined to see whether the new further function key operation is of the STOP key or not and if the function key operation is of the STOP key then the program returns to the above described stop routine and otherwise the program returns to the step F6.

At the step F11 the logic zero is loaded in the area "SEC" of the random access memory and at the step F12 the data of the area "TIMER" of the random access memory is reduced by one second. At the step F13 the data in the area "TIMER" is analyzed, and if the same is determined as "0" the program shifts to the buzzer routine (FIG. 10I) and otherwise the program shifts to the step F14. At the step F14 the power control routine (FIG. 10J) is executed.

At the first step J1 of the power control routine it is determined whether the heating energy intensity has already been set. More specifically, the data in the area "PWR" of the random access memory is analyzed and if the same is determined as the logic one the program shifts to the step J2, whereas if the same is determined as the logic zero the program returns to the step F15 of the start routine. Since at that time in the described sequence the data in the area "PWR" is the logic one, the program shifts to the step J2.

At the step J2 the data in the area "PWR A" of the random access memory is reduced by one, whereupon the data in the area "PWR A" is determined at the following step J3 as to whether the same is "0" and if the same is determined as "0" the program shifts to the step J4, whereas if the same is not "0" the program shifts to the step J7. In this case the data "10" has been loaded in the area "PWR A" at the step F5 of the start routine and accordingly the program shifts to the step J7.

At the step J7 the data in the area "PWR B" of the random access memory is reduced by one and at the following step J8 the data in the area "PWR B" is analyzed, and if the same is determined as "0" the program shifts to the step J9, whereas if the same is not "0" the program returns to the step F15 of the start routine. In this case the heating energy intensity "5" has been loaded in the area "PWR B" at the step F4 of the start routine and accordingly the program returns to the step F15.

Accordingly, the program makes recirculation of the respective steps F6 to F10 and F15 and, since the program passes the power control routine at every second in the above described recirculation, the program shifts to the step J9 at the time point when the data in the area "PWR B" of the random access memory becomes "0" i.e. five seconds after the start of execution of the start routine.

At the step J9 the signal PO obtained at the heat command output terminal F1 of the microprocessor is made unavailable, whereby microwave oscillalion is stopped. The program thereafter returns to the step F15 of the start routine.

In the further recirculation progress of the prgram, the program shifts to the step J4 at the time point where the data in the area "PWER A" of the random access memory becomes "0" i.e. ten senconds after the start of execution of the start routine.

At the step J4 the data "10" is loaded in the area "PWR A" of the random access memory and at the following step J5 the data in the area "PWER" of the random access memory, i.e. in this case the heating energy intensity "5", is loaded in the area "PWR B" and at the following step J6 the signal PO is made available at the heat command output terminal F2 of the microprocessor. The program then returns to the step F15 of the start routine.

Accordingly, the program makes recirculation of the respective steps F6 to F10 and F15 and the program progress passes the power control routine at every second in the above described recirculation, whereby microwave oscillation is caused to occur for five seconds in one cycle of ten seconds, with the result that the 50% output is obtained.

On the other hand, in the above described recirculation, the data in the area "TIMER" of the random access memory is reduced by one every second and at the time point where the data thereof becomes zero, i.e. in this case ten minutes after the start of execution of the start routine, the program shifts to the buzzer routine (FIG. 10I). Meanwhile, in the above described recirculation, the data in the area "TIMER" is displayed at the step F7. It is pointed out that the data being displayed is a time period left in the timer.

At the first step I1 of the buzzer routine, the signal PO is made unavailable at the heat command output terminal F1 of the microprocessor. The program then proceeds to the respective steps I2 to I6. At the step I2 "3" representing that a buzzer enabling period is three seconds is stored in the area "CNT3" of the random access memory. At the step I3 the signal BZ is provided at the buzzer output terminal F3 of the microprocessor. At the step I4 the data in the area "TIMER" of the random access memory is transferred to the area "DISPLAY". At the step I5 exactly the same process as that of the step A4 of the initial routine is executed. At the step I6 the data in the area "SEC" of the random access memory is determined to see the lapse of time in terms of seconds. More specifically, if and when the data is the logic zero the program returns to the step I4, whereas if the data is the logic one the program shifts to the step I7. At the step I7 the logic zero is loaded in the area "SEC". At the following step I8 the data in the area "CNT3" of zhe random access memory is reduced by "1" and at the following step I9 the data in the area "CNT3" is determined and if the same is not "0" the program shifts to the step I4, whereas if the same is "0" the program shifts to the step I10. At the step I10 the signal BZ at the buzzer output terminal F3 of the microprocessor is made unavailable.

Accordingly, upon initiation of execution of the buzzer routine, microwave oscillation is stopped and the buzzer is energized, while the program makes recirculation of the respective steps I4, I5 and I6, and during the above described recirculation at the time point where the data in the area "CNT3" of the random access memory becomes "0" after the passage of the respective steps I7, I8 and I9 at every second, i.e. three seconds after the start of execution of the buzzer routine, the program shifts to the step I10, whereby the buzzer energization is stopped. The program then shifts to the clear routine (FIG. 10G).

At the step G1 of the clear routine the respective areas in the random access memory, excluding the areas "CLOCK", "CNT1" and "CNT2", are all cleared and the program thereafter returns to the step A2 of the initial routine.

Accordingly, the program makes recirculation of the respective steps A2, A3, A4 and A5, unless new further key operation is made, while the current time is displayed by the display means 5 during the above described recirculation. More specifically, the microwave oven completes all the timer operation, whereby the same is placed in a stand-by state.

FIXED COOKING PROGRAM OPERATION I

Assuming a case where a material is cooked using the recipe No. 1 shown in Table I stored in the microwave oven, for example, key operation to be described in the following is made by means of the operating means 6. However, it is assumed that the quantity of a material being cooked is not considered at this time.

| RECIPE | 1 | START |
|---|---|---|

In the following, the progress of the program in accordance with the above described key operation sequence will be described.

The program has been recirculating the respective steps A2 to A5 of the initial routine, as described previously, and accordingly, if and when the RECIPE key is operated, the key operation is determined by the step A4, whereupon the program shifts to the step A8 through the respective steps A5, A6 and A7. At the step A8 the data in the area "FKB" of the random access memory is analyzed to see whether the above described key operation is of the RECIPE key. Since in this case the key operation is of the RECIPE key, the program shifts to the fixed cooking routine (FIG. 10K).

At the first step K1 of the fixed cooking routine the logic zero is loaded in the area "DISPLAY" of the random access memory, whereby the data therein is cleared, whereupon the program proceeds in succession to the respective steps K2 and K3. At the step K2 the data in the area "RECIPE" of the random access memory is transferred to the area "DISPLAY". At the step K3 exactly the same process as that of the step A4 of the initial routine is executed, whereupon the program shifts to the step K4.

At the step K4 the data in the area "FK" of the random access memory is determined and if the same is determined as the logic zero the program shifts to the step K9, whereas if the same is determined as the logic one the program shifts to the step K5. At the step K9 the data in the area "NK" of the random access memory is determined and if the same is determined as the logic zero the program shifts to the step K2, whereas if the same is determined as the logic one the program shifts to the step K10.

Upon leaving the above described step K3, since the data in the respective areas "FK" and "NK" of the random access memory is the logic zero, unless any new further key operation is made, the program makes recirculation of the respective steps K2, K3, K4 and K9, whereby the data "0000" is displayed by the display means 5.

Upon operation of the numeral key "1", such key operation is determined at the above described step K3, whereupon the program returns to the step K2 through the respective steps K4, K9, K10 and K11. At the step K10 the data in the area "NKB" of the random access memory is transferred to the area "RECIPE". At the step K11 the logic one is loaded in the area "SET" of the random access memory, whereby the fact that the recipe number has been set is stored.

Thereafter the program again recirculates the respective steps K2, K3, K4 and K9, until a new key operation is made, while the data in the area "RECIPE" is displayed during the above adescribed recirculation. In this case the data "0001" representing the recipe No. 1 is displayed by the display means 5.

If and when a new key operation is made, which is of a function key, the program returns to the step K2 through the respective steps K5, K6 and K7. At the respective steps K5, K6 and K7 the data in the area "FKB" of the random access memory is analyzed to see whether the same is of the QUANTITY key, the CLEAR key, or the START key, and if the same is of the QUANTITY key or the CLEAR key, immediately the program shifts to the quantity routine or the clear routine, respectively. If the key operation is of the START key, the program shifts to the step K8.

Since the above described further key operation in this case is of the START key, the program shifts to the step K8.

At the step K8 the data in the area "SET" of the random access memory is determined to see whether the recipe number has been set. More specifically, if and when the data in the area "SET" is the logic zero the recipe number is determined as not set and the pro*ram returns to the step K2, whereas if and when the data in the area "SET" is determined as the logic one the recipe number is determined as already set and the program proceeds to the step K12.

Since the data in the area "SET" in this example is the logic one, the program shifts to the step K12 and at the step K12 the data in the area "RECIPE" of the random access memory is determined to see whether the same is "1". If and when the same is not "1" the program shifts to the step K13 and at the said step similarly the data in the area "RECIPE" is determined as to whether the same is "2" and if the same is not "2" the program shifts to the step K14. Similarly thereafter; at the respective steps K14 to K19, the data in the area "RECIPE" is determined as to whether or not the same is "3" to "8".

Upon coincidence at the respective steps K12 to K19, the program shifts to the respective steps K20 to K27, whereas without coincidence at the step K19 the program shifts to the step K28.

At the respective steps K20 to K28 the cooking conditions of the respective recipes Nos. 1 to 9 are read out from the read only memory and are loaded in the areas of the random access memory. Such cooking conditions each contain a cooking time period and a valve of heating energy intensity, as described previously, which are stored in the area "TIMER" and the area "POWER", respectively, of the random access memory.

More specifically, since the recipe No. 1 has been selected in this particular case, the program shifts to the step K20, at which step the recipe No. 1 routine (FIG. 10M) is executed. At the first step M1 of the recipe No. 1 routine, the data "3" is loaded in the 1,1 address of the random access memory and at the following step M2 the data "8" is loaded in the 1,4 address of the random access memory. Accordingly, the cooking time period of three minutes and the heating energy intensity of 80% are loaded in the areas "TIMER" and "POWER", respectively, of the random access memory.

The program then shifts to the step K30 and at the step K30 the data in the area "QUANTITY" of the random access memory is determined as to whether or not the same is "0". Since in this particular case the data is "0" the program then enters to the start routine.

Upon entering into the start routine, as in the case of thd above described timer operation, the microwave oven is operated under the conditions of 80% heating energy intensity and of three minutes and upon termination of such operation, the program makes recirculation of the respective steps A2 to A5 of the initial routine, whereby the microwave oven is placed in a stand-by state.

In the above described FIXED COOKING PROGRAM OPERATION I, it should be noted that the cooking conditions such as the cooking time period and the heating energy intensity have not been entered by the data entry means 6, as distinguished from the case of the TIMER OPERATION.

FIXED COOKING PROGRAM OPERATION II

Assuming that a material to be cooked weighs as much as two times the above described reference weight (200 g) and is to be cooked in accordance with the recipe No. 1 stored in the microwave oven, modified to compensate for the above described increased weight, the key operation is made in the following manner by the data entry means 6:

| | | | | |
|---|---|---|---|---|
| RECIPE | 1 | QUANTITY | 2 | START |

In the following the progress of the program in accordance with the above described key operation sequence will be described.

When the RECIPE key and the numeral key "1" are operated, the program recirculates the respective steps K2, K3, K4 and K9 of the fixed cooking routine, as in the above described FIXED COOKING PROGRAM OPERATION I, while the data in the area "RECIPE" is displayed during the above described recirculation.

If and when the QUANTITY key is operated thereafter, the program enters into the quantity routine (FIG. 10L) from the step K5.

At the first step L1 of the quantity routine, the logic zero is loaded in the area "DISPLAY" of the random access memory, whereby the data is cleared, whereupon the program proceeds in succession to the respective steps L2 and L3. At the step L2 the data in the area "QUANTITY" of the random access memory is transferred to the area "DISPLAY". At the step L3 exactly the same process as that of the step A4 of the initial routine is executed, whereupon the program shifts to the step L4.

At the step L4 the data in the area "FK" of the random access memory is analyzed and if and when the data is determined as the logic zero the program shifts to the step L7, whereas if and when the data is determined as the logic one the program shifts to the step L5. At the step L7 the data in the area "NK" of the random access memory is determined and if and when the data is determined as the logic zero the program returns to the step L2, whereas if and when the data is determined as the logic one the program shifts to the step L8.

Upon leaving the above described step L3, since the data in the respective areas "FK" and "NK" of the random access memory is the logic zero, unless a new key operation is made, the program makes respective steps L2, L3, L4 and L7, while the data "0000" is displayed by means of the display means 5.

If and when the numeral key "2" is operated, such key operation is determined at the above described step L3, whereupon the program shifts to the step L7 and then to the step L3, whereupon the program shifts to the step L7 and then to the step L8. At the step L8 the data in the area "NKB" of the random access memory is transferred to the area "QUANTITY".

Thereafter the program recirculates the respective steps L2, L3 and L4 and L7 until a new key operation is made, while the data in the area "QUANTITY" is displayed during the above described recirculation. More specifically, in this particular case an indication "0002" representing the quantity "2" is made by the display means 5.

If and when a new key operation is made thereafter, which is of a function key, then the program returns to the step L2 through the respective steps L5 and L6. At the respective steps L5 and L6, the data in the area "FKB" of the random access memory is determined to see whether the key operation is of the START key or the CLEAR key. If the key operation is of the START key the program immediately shifts to the step K8 of the fixed cooking routine, whereas if the key operation is of the CLEAR key the program enters into the clear routine.

Since the above described new key operation is of the START key in this particular case, the program shifts to the step K8 of the fixed cooking routine. The program then sequentially proceeds to the respective steps K8, K12 and K20 as described in the FIXED COOKING PROGRAM OPERATION I and at the step K20 the cooking time period of three minutes and the heating energy intensity of 80% are loaded in the area "TIMER" and the area "POWER", respectively, of the random access memory. The program then shifts to the step K30 wherein the data in the area "QUANTITY" of the random access memory is determined as to whether the same is "0" and, since in this particular case the data is not "0" the program shifts to the step K31. At the step K31 the data in the area "QUANTITY" of the random access memory is determined and if and when the same is "1" the program enters into the start routine, whereas if and when the same is not "1" the program shifts to the step K32. At the step K32 the data in the area "QUANTITY" is similarly determined as to whether the same is "2" and, if the same is not "2", then the program shifts to the step K33. Similarly thereafter the data in the area "QUANTITY" of the random access memory is determined as to whether the same is "3" to "8" at the respecfive steps K33 to K38.

Upon coincidence at the respective steps K32 to K38, the program shifts to the respective steps K39 to K45, respectively, while upon non-coincidence at the step K38, the program shifts to the step K46.

Upon coincidence at one of the respective steps K39 to K46, the respective expansion coefficient corresponding to the quantities "2" to "9" is read out from the read only memory, whereupon the same is written in the area "QK" of the random access memory.

In this particular case, since the quantity "2" has been selected, the quantity "2" routine (FIG. 10N) is executed at the step K39. At the first step N1 of the quantity "2" routine, "1" is loaded in the 2, 6 address of the random access memory and at the following step N2 "6" is loaded in the 2, 7 address of the random access memory. Accordingly, this means that the numerical value representing the expansion coefficient "1.6" is loaded in the area "QK" of the random access memory. The program then shifts to the step K47.

At the step K47, "0" is loaded in the area "TIMER B" of the random access memory, whereby the same is cleared, and at the following step K48 the data in the area "TIMER" and the data in the area "QK" of the random access memory are multiplied, whereupon the product of the multiplication is loaded in the area "TIMER B" of the random access memory. In this particular case, since the data in the area "TIMER" is three minutes and the data in the area "QK" is the coefficient "1.6", it follows that the data "0448" representing 4.8 minutes is stored in the area "TIMER B".

The program then shifts to the step K49 and at the step K49 the data in the area "TIMER B" of the random access memory is transferred to the area "TIMER", whereupon the program enters into the start routine.

Upon entering into the start routine, the operation of the microwave oven is performed with a heating energy intensity of 80% and a cooking time period of 4 minutes 48 seconds, as in the case of the above described TIMER OPERATION, and after the operation is ended, the program recirculates the respective steps A2 to A5 of the initial routine, whereby the microwave oven is placed in a stand-by state.

It should be noted that in the above described FIXED COOKING PROGRAM OPERATION II a cooking condition (the cooking time period in the embodiment shown) of the recipe as designated by means of the RECIPE key has been modified according to the quantity (the weight in the embodiment shown) of a material to be cooked, as distinguished different from the case of the above described FIXED COOKING PROGRAM OPERATION I. More specifically, although the cooking conditions as stored in the microwave oven correspond to a unit quantity of the material to be cooked, a necessary compensation for the weight of the material to be cooked is made by entering a reference weight multiple by means of the QUANTITY key, thereby setting proper modified cooking conditions.

In practicing the above described embodiments, if various keys corresponding to the kinds of recipes are provided with specific names of recipes, then the inventive microwave oven would be more convenient. Although in the above described embodiments the cooking time period was changed in accordance with the characteristics of the material to be cooked, alternatively the heating energy industry may be changed.

Furthermore, although in the above described embodiments the data concerning the weight of the material to be cooked was entered by way of said reference weight multiple, alternatively the apparatus may be structured such that the weight value of a material may be directly entered. If the apparatus is structured such that the weight value of a material is directly entered, then such weight value may be converted into a coefficient with respect to the above described unit quantity, in which case conversion of the weight value of a material into a reference weight multiple unnecessary in association with the entry of data into the apparatus.

Although the present invention has been described and illustrated in detail, it is to be clearly understood that the same is by way of illustration and example only and is not to be taken by way of limitation, the spirit and scope of the present invention being limited only by the terms of the apended claims.

What is claimed is:

1. A microwave oven, comprising:

means defining a chamber for receiving a quantity of a material to be cooked, microwave generating means for supplying microwave energy to said chamber for heating the material to be cooked, said microwave oven having a non-linear relation between the quantity of a material being cooked and the rate at which microwave energy is supplied to said material from said microwave generating means in performing a cooking operation, storage means for storing first data non-linearly associated with said quantity of material and compensating for said non-linear relation of said oven and storing second data defining a plurality of cooking conditions corresponding to a plurality of kinds of recipes, entry means having a plurality of numeral keys and at least two function keys for entering data concerning a kind of recipe and a quantity of a material to be cooked, cooking condition providing means responsive to said data concerning the kind of recipe and said quantity of a material being cooked entered by said entry means for accessing said second and first data in said storage means and for modifying the cooking condition data by the first data in said storage means for providing modified cooking condition data, and control means for controlling said microwave generating means responsive to said modified cooking condition data provided by said cooking condition providing means, wherein a plurality of said cooking conditions stored in said storage means corresponds to a unit quantity of a material to be cooked, and at least one function key is used for entering said quantity data as a multiple with respect to said unit quantity, wherein said storage means includes means for storing said first data in terms of a plurality of expansion coefficients corresponding to a plurality of different quantities of a material to be cooked, and wherein one or more of said cooking conditions stored in said storage means corresponds to a unit quantity of a material to be cooked, and said storage means stores each of said expansion coefficients with respect to each of a plurality of multiples of said unit quantity, further comprising:

remaining time period evaluating means responsive to said control means for evaluating a remaining cooking time period of said microwave generating means, wherein said second data of said storage means includes a cooking time period, said oven further comprising display means responsive to said cooking condition providing means for displaying the cooking time period.

* * * * *